United States Patent [19]

Yoshida et al.

[11] Patent Number: 5,009,973

[45] Date of Patent: Apr. 23, 1991

[54] IMAGE FORMING METHOD AND IMAGE FORMING APPARATUS

[75] Inventors: Satoshi Yoshida, Kawasaki; Toshiaki Nakahara, Tokyo; Hirohide Tanikawa, Yokohama; Kiichiro Sakashita, Inagi, all of Japan

[73] Assignee: Canon Kabushiki Kaisha, Tokyo, Japan

[21] Appl. No.: 317,182

[22] Filed: Feb. 28, 1989

[30] Foreign Application Priority Data

Feb. 29, 1988 [JP] Japan ..... 63-46890

[51] Int. Cl.[5] ..... G03G 13/01; G03G 13/09; G03G 15/01; G03G 15/09

[52] U.S. Cl. ..... 430/45; 430/106.6; 430/111; 430/122; 355/251

[58] Field of Search ..... 430/45, 106.6, 111, 430/122; 355/251

[56] References Cited

U.S. PATENT DOCUMENTS

| | | | |
|---|---|---|---|
| 3,674,736 | 7/1972 | Lerman et al. | 430/111 X |
| 3,969,251 | 7/1976 | Jones et al. | 430/111 X |
| 4,165,393 | 8/1979 | Suzuki et al. | 430/122 |
| 4,239,845 | 12/1980 | Tanaka et al. | 430/122 |
| 4,284,701 | 8/1981 | Abbott et al. | 430/111 |
| 4,500,616 | 2/1985 | Haneda et al. | 430/45 |
| 4,543,312 | 9/1985 | Murakawa et al. | 430/106.6 X |
| 4,572,647 | 2/1986 | Bean et al. | 430/122 X |
| 4,737,433 | 4/1988 | Rimai et al. | 430/111 |

FOREIGN PATENT DOCUMENTS

| | | | |
|---|---|---|---|
| 0193069 | 9/1986 | European Pat. Off. . | |
| 0291296 | 11/1988 | European Pat. Off. . | |
| 0314459 | 5/1989 | European Pat. Off. . | |
| 53-83630 | 7/1978 | Japan | 430/122 |
| 59-31969 | 2/1984 | Japan | 430/45 |
| 60-51848 | 3/1985 | Japan . | |
| 62-90687 | 4/1987 | Japan . | |
| 62-209542 | 9/1987 | Japan . | |
| 62-288880 | 12/1987 | Japan . | |
| 63-218969 | 9/1988 | Japan | 430/122 |

*Primary Examiner*—7
*Assistant Examiner*—Roland Martin
*Attorney, Agent, or Firm*—Fitzpatrick, Cella, Harper & Scinto

[57] ABSTRACT

An image forming apparatus, comprises: an electrostatic image-bearing member for holding an electrostatic latent image; a developing means for developing the electrostatic latent image to form a toner image on the electrostatic image-bearing member, the developing means including a non-magnetic color toner developing means for development with a developer comprising a non-magnetic color toner and a magnetic toner developing means for development with a magnetic toner, wherein the non-magnetic toner has a volume-average particle size of 4 to 15 microns, the magnetic toner contains 17 to 60% by number of magnetic toner particles having a particle size of 5 microns or smaller, 1-23% by number of magnetic toner particles having a particle size of 8.0-12.7 microns and 2.0% by volume or less of magnetic toner particles having a size of 16 microns or larger, and the magnetic toner has a volume-average particle size of 4-9 micron and a degree of aggregation of 50-95%; a transfer means for transferring the toner image formed on the electrostatic image-bearing member to a transfer-receiving material; and a cleaning means for blade-cleaning the surface of the electrostatic image-bearing member after the transfer.

99 Claims, 7 Drawing Sheets

IMAGE FORMING METHOD AND IMAGE FORMING APPARATUS

FIELD OF THE INVENTION AND RELATED

The present invention relates to an image forming method such as an electrophotographic method or an electrostatic recording method wherein a magnetic toner and a non-magnetic toner are used, and an image forming apparatus therefor.

Recently, as image forming apparatus such as electrophotographic copying machines have widely been used, their uses have also extended in various ways, and higher image quality has been demanded. For example, when original images such as general documents and books are copied, it is demanded that even minute letters are reproduced extremely finely and faithfully without thickening or deformation, or interruption. However, in ordinary image forming apparatus such as copying machines for plain paper, when the latent image formed on a photosensitive member thereof comprises thin-line images having a width of 100 microns or below, the reproducibility of thin lines is generally poor and the clearness of line images is still insufficient.

Particularly, in recent image forming apparatus such as electrophotographic printer using digital image signals, the resultant latent picture is formed by a gathering of dots with a constant potential, and the solid, half-tone and highlight portions of the picture can be expressed by varying densities of dots. However, in a state where the dots are not faithfully covered with toner particles dots and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic.

On the other hand, in image forming apparatus such as electrophotographic copying machine, there sometimes occurs a phenomenon such that good image quality is obtained in an initial stage but it deteriorates as the copying or print-out operation is successively conducted. The reason for such phenomenon may be considered that only toner particles which contribute to the developing operation are consumed preferentially as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3942979, 3969251 and 4112024) has proposed a non-magnetic toner wherein the particle size distribution is regulated so as to improve the image quality. This toner comprises relatively coarse particles and most suitably comprises about 60% or more of toner particles having a particle size of 8–12 microns. However, according to our investigation, it is difficult for such a particle size to provide uniform and dense cover-up of the toner particles to a latent image. Further, the above-mentioned toner has a characteristic such that it contains 30% by number or less (e.g., about 29% by number) of particles of 5 microns or smaller and 5% by number or less (e.g., about 5% by number) of particles of 20 microns or larger, and therefore it has a broad particle size distribution which tends to decrease the uniformity in the resultant image. In order to form a clear image by using such relatively coarse toner particles having a broad particle size distribution, it is necessary that gaps between the toner particles are filled by thickly superposing the toner particles thereby to enhance the apparent image density. As a result, there arises a problem that the toner consumption increases in order to obtain a prescribed image density.

Japanese Laid-Open Patent Application No. 2054/1979 (corresponding to U.S. Pat. No. 4284701) has proposed a non-magnetic toner having a sharper particle size distribution than the above-mentioned toner. In this toner, particles having an intermediate weight has a relatively large particle size of 8.5–11.0 microns, and there is still left a room for improvement as a toner for a high resolution.

Japanese Laid-Open Patent Application No. 29437/1983 (corresponding to British Patent No. 114310) has proposed a non-magnetic toner wherein the average particle size is 6–10 microns and the mode particle size is 5–8 microns. However, this toner only contains particles of 5 microns or less in a small amount of 15% by number or below, and it tends to form an image without sharpness.

On the other hand, as a diversity of information is used, there has been desired an image forming method or image forming apparatus capable of recording image data of two colors or more than two colors, and various apparatus and recording methods have already been proposed.

In a two-color image forming method, e.g., a two-color image forming method by the electrophotographic recording system known heretofore, an initial charge is uniformly provided to the surface of an electrostatic image-bearing member such as a photosensitive drum by a corona charger first of all, and the photosensitive drum surface is subjected to negative exposure corresponding to first color image data to form a first latent image. Then, the latent image is developed by a color toner developing apparatus using a two-component magnetic brush developer comprising a mixture of, e.g., a red non-magnetic toner and a magnetic carrier to form a red toner image, which is then transferred to a transfer-receiving material and is fixed thereon. The photosensitive drum after the transfer is cleaned and the surface thereof is charged to a prescribed potential by a charger. Then, the charged photosensitive drum surface is subjected to negative exposure corresponding to a second color image data to form a second latent image. Further, the second latent image is developed by a second magnetic toner developing apparatus using a one-component magnetic developer comprising e.g., a black one-component magnetic toner to form a second black toner image. Then, the toner image is transferred to a transfer-receiving material by using a transfer means, and the second color toner image transferred to the transfer-receiving material is fixed by a fixing means such as heat pressure roller fixing means to form a two-color image.

In such a two-color developing system using a magnetic toner and a non-magnetic toner, there is liable to occur a problem that the non-magnetic toner passes by the cleaning step to remain on the photosensitive drum and provide an ill effect to the subsequent developing step. A magnetic toner, compared with a non-magnetic toner, is liable to damage the photosensitive drum surface, so that the blade cleaning condition therefore has to be relaxed relative to the optimum blade cleaning condition for the non-magnetic toner. Therefore, in case where a single cleaning blade is used for cleaning of both a magnetic toner and a non-magnetic color toner, the non-magnetic toner has a higher tendency of passing through the cleaning blade in the cleaning step.

Hitherto, there have been proposed several methods for enhancing the cleaning characteristic. For example, it has been well-known to add a lubricating agent such as polytetrafluoroethylene, polyethylene, a higher fatty acid metal salt, molybdenum dioxide, and graphite. This method shows an effect but also a problem of filming on the photosensitive member which may be attributable to the toner or lubricant. In order to solve the problem, the kind and the addition amount of the lubricating agent have been considered, but no satisfactory results have been obtained.

Japanese Laid-Open Patent Application No. 47345/1983 (corresponding to U.K. Patent No. 1402010) has proposed a method of using a friction-reducing substance and an abrasive substance. This method however involves a problem that the essential effects of the friction-reducing substance and the abrasive substance are cancelled by each other. Further, because such two substances which are not essential to a toner are contained in a toner, a highly skilled technique is required for providing an appropriate triboelectric charge and fixability which are essential to the toner. Therefore, the use of this method is practically serially restricted.

SUMMARY OF THE INVENTION

An object of the present invention is to provide an image forming method and an image forming apparatus having solved the above-mentioned problems.

A more specific object of the present invention is to provide an image forming method and an image forming apparatus capable of forming a toner image of two or more colors with little image soiling or contamination.

Another object of the present invention is to provide an image forming method and an image forming apparatus for forming a toner image of two or more colors wherein the cleaning step is satisfactorily operated.

A further object of the present invention is to provide an image forming method and an image forming apparatus using a specific magnetic toner and a non-magnetic color toner which provide a high image density and excellent thin-line reproducibility and gradational characteristic.

A further object of the present invention is to provide an image forming method and an image forming apparatus using a magnetic toner and a non-magnetic color toner capable of providing a high image density with a small consumption.

A still further object of the present invention is to provide an image forming method and an image forming apparatus, wherein the cleaning performance is improved, and the filming phenomena on a photosensitive member and its accompanying image defects, such as blurring, fading or flow, are prevented to stably provide good image for a long period.

According to our investigation it has been found that toner particles having a particle size of 5 microns or smaller have a primary function of clearly reproducing the contour of a latent image and of attaining close and faithful cover-up of the toner to the entire latent image portion. Particularly, in the case of an electrostatic latent image formed on a photosensitive member, the field intensity in the edge portion thereof as the contour is higher than that in the inner portion thereof because of the concentration of the electric lines of force, whereby the sharpness of the resultant image is determined by the quality of toner particles collected to this portion. According to our investigation, it has been found that the control of quantity and distribution state of toner particles of 5 microns or smaller is effective in solving the problem in image sharpness.

According to further study of ours, the use of a specific magnetic toner in a cleaning step is effective for stably providing good images for a long period. More specifically, the magnetic toner is caused to aggregate at a position where the photosensitive member and the cleaning member abut each other to provide an improved cleaning performance, and the non-magnetic color toner is prevented from passing by the cleaning action by the function of the magnetic toner particles per se aggregated to an appropriate degree, whereby the photosensitive drum is uniformly abraded to an appropriate degree to prevent the filming of the lubricating agent, the toner and others on the photosensitive drum and also the surface degradation of the photosensitive member, thus preventing blurring, fading or flow of images. Further, the abrading effect is stably shown for a long period even after repetitive image formation.

The present invention is based on the above findings.

Thus, according to the present invention, there is provided an image forming method, comprising:

developing an electrostatic latent image on an electrostatic image-bearing member with a developer comprising a non-magnetic color toner having a volume-average particle size of 4 to 15 microns to form a non-magnetic color toner image;

transferring the non-magnetic color toner image on the electrostatic image-bearing member to a transfer-receiving material;

cleaning the electrostatic image-bearing member after the transfer with a cleaning blade;

forming an electrostatic image on the electrostatic image-bearing member after the cleaning;

developing the electrostatic latent image on the electrostatic image-bearing member with a developer comprising a magnetic toner to form a magnetic toner image, wherein the magnetic toner contains 17 to 60% by number of magnetic toner particles having a particle size of 5 microns or smaller, 1–23% by number of magnetic toner particles having a particle size of 8.0–12.7 microns and 2.0% by volume or less of magnetic toner particles having a size of 16 microns or larger, and the magnetic toner has a volume-average particle size of 4–9 microns and a degree of aggregation of 50–95%;

transferring the magnetic toner image on the electrostatic image-bearing member to the transfer-receiving material; and cleaning the electrostatic image-bearing member after the transfer with a cleaning blade.

According to the present invention, there is further provided an image forming method, comprising:

developing an electrostatic latent image on an electrostatic image-bearing member with a developer comprising a magnetic toner to form a magnetic toner image, wherein the magnetic toner contains 17 to 60% by number of magnetic toner particles having a particle size of 5 microns or smaller, 1–23% by number of magnetic toner particles having a particle size of 8.0–12.7 microns and 2.0% by volume or less of magnetic toner particles having a size of 16 microns or larger, and the magnetic toner has a volume-average particle size of 4–9 microns and a degree of aggregation of 50–95%;

transferring the magnetic toner image on the electrostatic image-bearing member to a transfer-receiving material;

cleaning the electrostatic image-bearing member after the transfer with a cleaning blade;

forming an electrostatic image on the electrostatic image-bearing member after the cleaning;

developing the electrostatic latent image on the electrostatic image-bearing member with a developer comprising a non-magnetic color toner having a volume-average particle size of 4 to 15 microns to form a non-magnetic color toner image;

transferring the non-magnetic color toner image on the electrostatic image-bearing member to the transfer-receiving material; and cleaning the electrostatic image-bearing member after the transfer with a cleaning blade.

According to another aspect of the present invention, there is further provided an image forming apparatus, comprising:

an electrostatic image-bearing member for holding an electrostatic latent image;

a developing means for developing the electrostatic latent image to form a toner image on the electrostatic image-bearing member, the developing means including a non-magnetic color toner developing means for development with a developer comprising a non-magnetic color toner and a magnetic toner developing means for development with a magnetic toner, wherein the non-magnetic toner has a volume-average particle size of 4 to 15 microns, the magnetic toner contains 17 to 60% by number of magnetic toner particles having a particle size of 5 microns or smaller, 1–23% by number of magnetic toner particles having a particle size of 8.0–12.7 microns and 2.0% by volume or less of magnetic toner particles having a size of 16 microns or larger, and the magnetic toner has a volume-average particle size of 4–9 microns and a degree of aggregation of 50–95%;

a transfer means for transferring the toner image formed on the electrostatic image-bearing member to a transfer-receiving material; and a cleaning means for blade-cleaning the surface of the electrostatic image-bearing member after the transfer.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
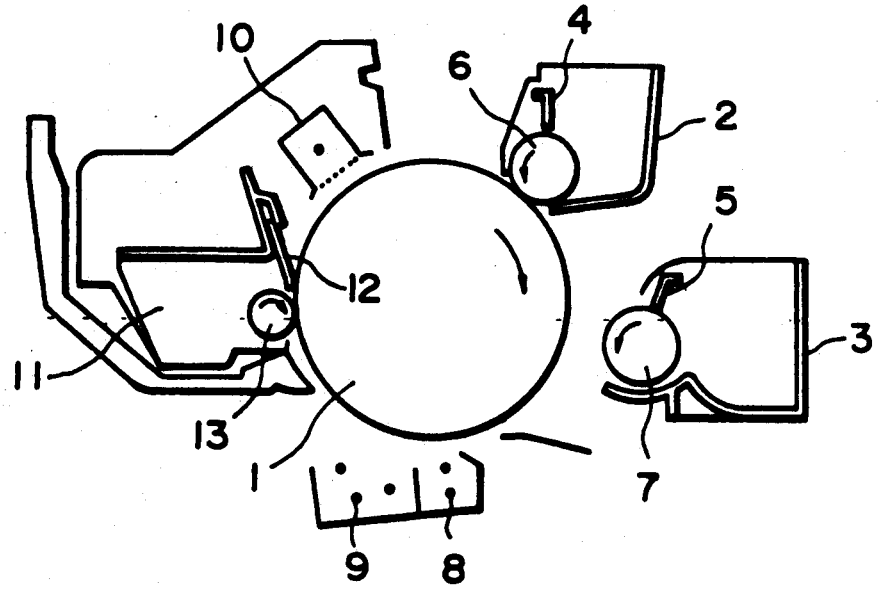
FIGS. 1 and 2 are schematic sectional views showing two states of an image forming apparatus according to the present invention.

The magnetic toner used in the image forming method and the image forming apparatus of the present invention has a relatively large degree of aggregation of 50–95% and remains in an appropriate amount of the cleaning blade to show an excellent effect of cleaning a color toner remaining on the photosensitive member after the transfer. The magnetic toner also shows an appropriate abrasive function preventing the filming of a lubricating agent or toner on the photosensitive member, thus stably providing a high quality image for a long period.

The reason why the magnetic toner shows such an effect in the present invention will be explained hereinbelow.

The magnetic toner used in the present invention has a volume-average particle size of 4–9 microns and contains 17–60% by number of magnetic toner particles having a particle size of 5 microns or smaller, thus being smaller in particle size and containing more fine particles compared with most of the known magnetic toners. Corresponding thereto, a sufficient cleaning performance is provided by its aggregation characteristic in blade cleaning. The magnetic toner having a large aggregation characteristic of the present invention causes an appropriate degree of aggregation and compression of magnetic toner particles at the abutting position of the photosensitive member and cleaning member, so that the non-magnetic color toner is prevented from passing between the photosensitive member and cleaning member and is scraped from the photosensitive member by the cleaning member to be reliably recovered in the cleaner. Another advantage of the magnetic toner of the present invention is that the magnetic toner aggregated in the neighborhood of the abutting position between the photosensitive member and the cleaning member has an appropriate abrasive function by itself. As a result, the addition of an abrasive agent which can adversely affect development, transfer and fixing may be omitted or minimized to an extent of no harm while avoiding undesirable phenomena such as fading or flow due to filming on the photosensitive member or degradation of the photosensitive member surface to stably provide good images.

In this way, the magnetic toner of the present invention provides a solution to the problems of the prior art based on an utterly different concept from the prior art and makes it possible to stably provide good images for a long period, which also satisfy a recent strict requirement of high quality. In the present invention, it is necessary that the non-magnetic color toner has a volume-average particle size of 4–15 microns, preferably 5 to 15 microns, in relation to the magnetic toner. In view of the blade cleaning performance, it is preferred that the non-magnetic color toner has a volume-average particle size which is larger than that of the magnetic toner by 1 micron or more, more preferably 1–8 microns.

The image forming method and apparatus according to the present invention will now be explained with reference to the accompanying drawings based on an example wherein a magnetic black toner and a non-magnetic color toner are used for two-color superposing copy operation.

FIGS. 1 through 4 show an electrostatic image-bearing member (hereinafter called a "photosensitive drum") such as that formed from an organic photoconductive material, amorphous silicon photosensitive material, selenium photosensitive material or zinc oxide photosensitive material, and surrounding structure of a copying machine capable of superposing operation. Referring to FIGS. 1 through 4, a two-color superposing operation is explained.

Figure 2:
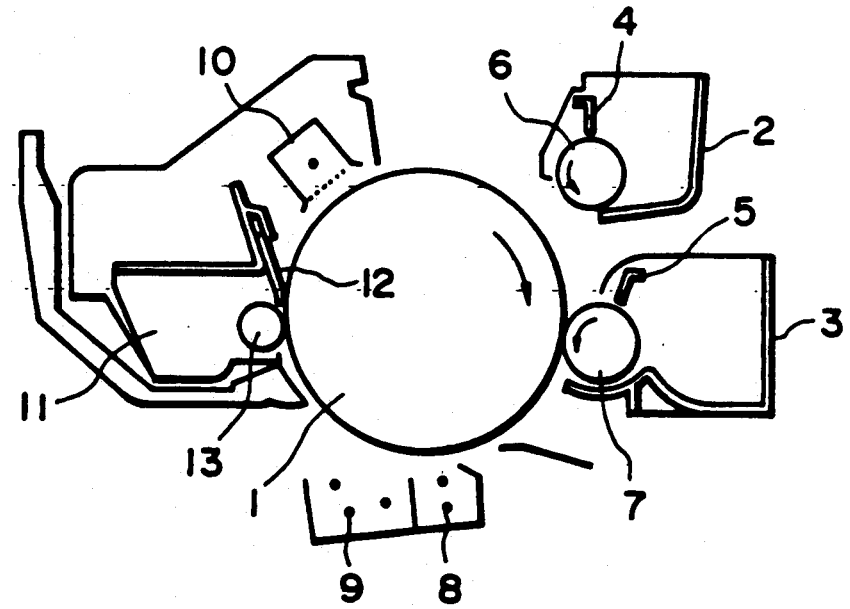
Figure 3:
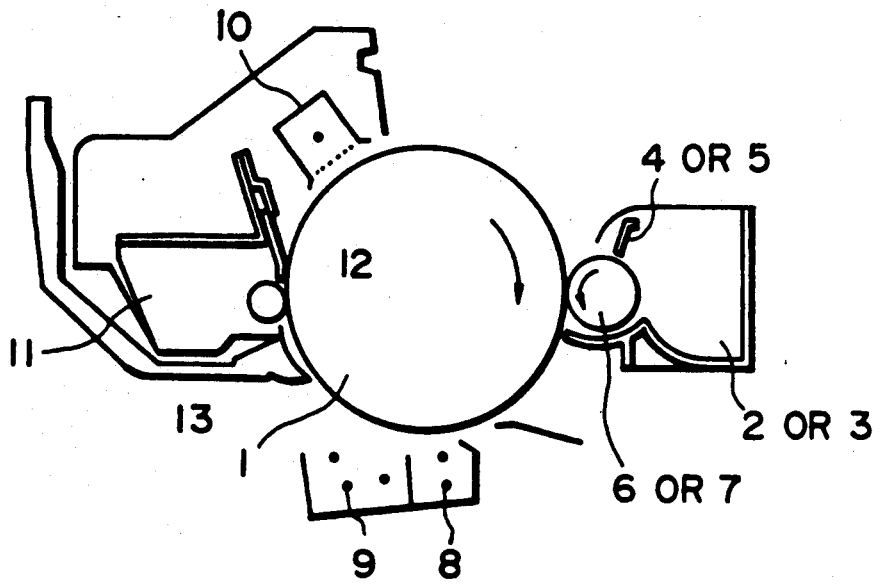
FIG. 3 is a schematic sectional view showing another embodiment of the image forming apparatus according to the present invention.

Adjacent to a photosensitive drum 1, a non-magnetic color toner developing unit 2 and a magnetic toner developing unit 3 are provided and are alternately pressed against the photosensitive drum 1 for development (FIGS. 1 and 2). For example, as a step 1, close to the photosensitive drum 1 having an electrostatic latent image formed thereon, the non-magnetic color toner developing unit 2 is disposed, and development is effected with a developer comprising a non-magnetic color toner and a magnetic carrier applied on a sleeve 6 in a thin layer by means of a blade 4 for coating. Then, the resultant non-magnetic toner image is transferred to a transfer-receiving material at a transfer and separating position. Then, the toner remaining on the photosensitive member after the transfer is removed by a cleaning blade 12 and a cleaning roller 13 disposed in a cleaner unit 11 (FIG. 1), and the non-magnetic color toner image on the transfer paper is fixed by means of a heat-pressure roller fixing device (not shown). Subsequently, as a step 2, an electrostatic latent image is newly formed on the photosensitive drum 1, and a magnetic toner developing unit 3 is moved close thereto. The latent image is developed with a magnetic toner applied in a thin layer on a sleeve 7 by means of a blade 5 for coating to form a magnetic toner image, which is then transferred to the transfer-receiving material having thereon the non-magnetic color toner image in advance at the transfer and separation position. The remaining toner on the photosensitive drum 1 after transfer is removed again by the cleaning blade 12 and the cleaning roller 13 in the cleaner unit 11 (FIG. 2). Two-color superposing operation can be effected continuously by repeating the above operations. In this instance, it is also possible to successively repeat the first step to accumulate a desired number of the transfer-receiving materials in the copying machine and then to repeat the second step to form a large number of two-color superposed copies. Further, as shown in FIG. 3, it is possible that a non-magnetic color toner developing unit 2 is disposed to effect the development, transfer, cleaning and fixing in the same manner as in the above first step, then the developing unit is replaced by a magnetic toner developing unit 3 to similarly effect the second step to effect two-color superposing operation.

Figure 4A:
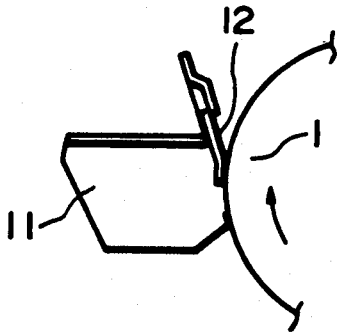
FIGS. 4A, 4B and 4C are schematic sectional views of a cleaning unit for illustrating cleaning steps of the present invention.
Figure 4B:
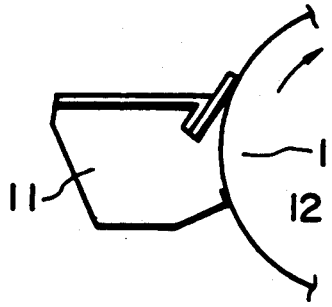
Figure 4C:
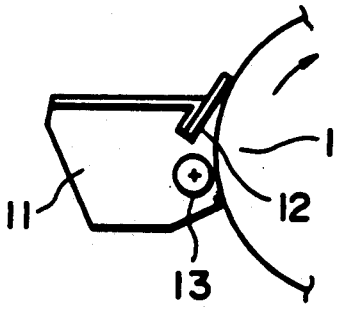

The cleaner unit 11 can be of various types and some of them are explained. Referring to FIGS. 4A and 4B, a cleaning blade 12 comprising an elastic material such as urethane rubber or silicone rubber is caused to contact the surface of the photosensitive drum 1 in a counter- or forward-direction to remove the remaining toner after transfer. As shown in FIGS. 1–3 and FIG. 4C, a cleaning roller 13 comprising an elastic material such as urethane rubber or silicone rubber is used for rubbing to enhance the effect of removal. Further, in case of a magnetic toner, a cleaning roller 13 is composed as a magnetic roller comprising a magnetic material and is disposed close to the photosensitive member to form years or brush of the magnetic toner on the magnetic roller, by which the surface of the photosensitive member is brushed. The cleaning blade used in the present invention may preferably be formed of polyurethane or silicone rubber and have a thickness of about 0.5 to 4 mm, preferably 1.5–3 mm and a JIS-A rubber hardness of 50 degrees to 90 degrees. The blade pressure against the photosensitive member surface may preferably be 5–40 g/cm. The cleaning roller used in the present invention may preferably be formed of polyurethane rubber or silicone rubber and have a JIS-A hardness of 20 degrees to 90 degrees. The cleaning roller may preferably be pushed against the photosensitive member to provide a depression of 0.5 to 2 mm and moved at a peripheral speed which is 50–200% of that of the photosensitive member.

The magnetic toner used in the present invention can faithfully reproduce thin lines in a latent image formed on a photosensitive member, and is excellent in reproduction of dot latent images such as halftone dots and digital images, whereby it provides images excellent in gradation and resolution characteristics. Further, the toner according to the present invention can retain a high image quality even in the case of successive copying or print-out, and can effect good development by using a smaller consumption thereof as compared with the conventional magnetic toner, even in the case of high-density images. As a result, the magnetic toner of the present invention is excellent in economical characteristics and further has an advantage in miniaturization of the main body of a copying machine or printer.

The reason for the above-mentioned effects of the magnetic toner of the present invention is not necessarily clear but may assumably be considered as follows.

The magnetic toner of the present invention is first characterized in that it contains 17–60% by number of magnetic toner particles of 5 microns or below. Conventionally, it has been considered that magnetic toner particles of 5 microns or below are required to be positively reduced because the control of their charge amount is difficult, they impair the fluidity of the magnetic toner, and they cause toner scattering to soil or contaminate the machine.

However, according to our investigation, it has been found that the magnetic toner particles of 5 microns or below are an essential component to form a high-quality image.

For example, we have conducted the following experiment.

Thus, there was formed on a photosensitive member a latent image, wherein the surface potential on the photosensitive member was changed from a large developing potential contrast at which the latent image would easily be developed with a large number of toner particles, to a small developing potential contrast at which the latent image would be developed with only a small number of toner particles.

Such a latent image was developed with a magnetic toner having a particle size distribution ranging from 0.5 to 30 microns. Then, the toner particles attached to the photosensitive member were collected and the particle size distribution thereof was measured. As a result, it was found that there were many magnetic toner particles having a particle size of 8 microns or below, particularly 5 microns or below. Based on such finding, it was discovered that when magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The magnetic toner of the present invention is further characterized in that it contains 1-23% by number of magnetic toner particles of 8-12.7 microns. Such a feature relates to the above-mentioned necessity for the presence of the toner particles of 5 microns or below.

As described above, the toner particles having a particle size of 5 microns or below have the ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion appears to be lower. Particularly, the magnetic toner particles of 5 microns or below strongly have such tendency. However, we have found that when 1-23% by number of toner particles of 8-12.7 microns are contained in a toner, not only the above-mentioned problem can be solved but also the resultant image can be made clearer.

According to our knowledge, the reason for such phenomenon may be considered that the toner particles of 8-12.7 microns have suitably controlled charge amount in relation to those of 5 microns or below, and that these toner particles are supplied to the inner portion of the latent image having a lower field intensity than that of the edge portion thereby to compensate for the decrease in cover-up of the toner particles to the inner portion as compared with that in the edge portion, and to form a uniform developed image. As a result, there may be provided a sharp image having a high-image density and excellent resolution and gradation characteristic.

In the magnetic toner of present invention, magnetic toner particles having a particle size of 16 microns or larger are contained in an amount of 2.0% by volume or below. The amount of these particles may preferably be as small as possible.

It is preferred in the magnetic toner of the present invention that toner particles having a particle size of 5 microns or smaller contained therein satisfy the following relation between their percentage by number (N) and percentage by volume (V):

$$N/V = -0.04N + k,$$

wherein $4.5 \leqq k \leqq 6.5$, and $17 \leqq N \leqq 60$.

Figure 5:
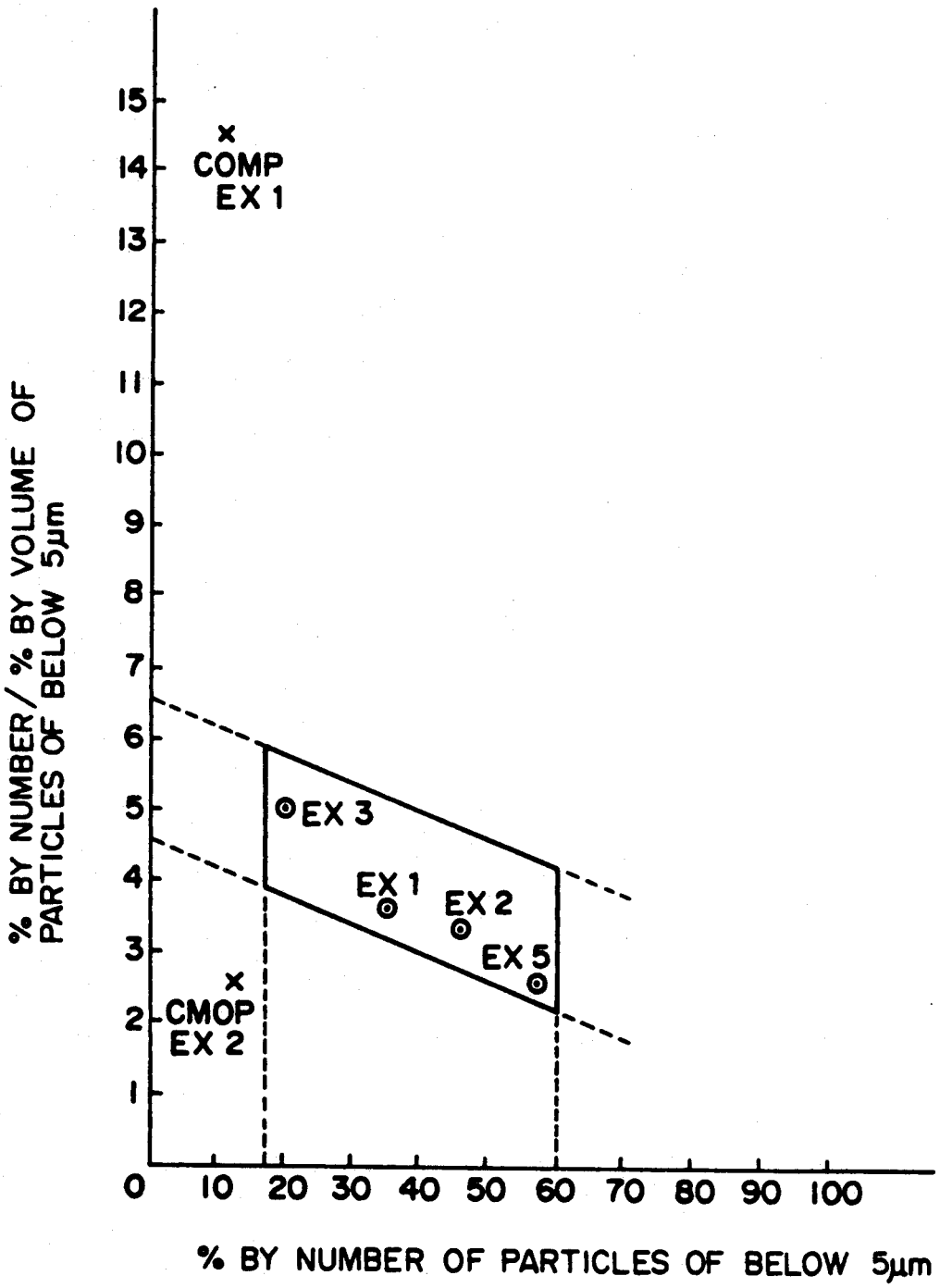
FIG. 5 is a graph showing the relationships between % by number (N) and % by volume (V) of magnetic toner particles having a particle size of 5 microns or smaller in several examples of the magnetic toner according to the present invention and comparative magnetic toners.

The region satisfying such a relationship is shown in FIG. 5. The magnetic toner according to the present invention which has the particle size distribution satisfying such region, in addition to the above-mentioned features, can attain excellent developing characteristic.

According to our investigation on the state of the particle size distribution with respect to toner particles of 5 microns or below, we have found that there is a suitable state of the presence of fine powder in magnetic toner particles. More specifically, in the case of a certain value of N, it may be understood that a large value of N/V indicates that the particles of 5 microns or below (e.g., 2-4 microns) are significantly contained, and a small value of N/V indicates that the frequency of the presence of particles near 5 microns (e.g., 4-5 microns) is high and that of particles having a smaller particle size is low. When the value of N/V is in the range of 2.1-5.82, N is in the range of 17-60, and the relation represented by the above-mentioned formula is satisfied, good thin-line reproducibility and high resolution are attained.

Hereinbelow, the present invention will be described in more detail.

In the present invention, the magnetic toner particles having a particle size of 5 microns or smaller are contained in an amount of 17-60% by number, preferably 25-50% by number, more preferably 30-50% by number, based on the total number of particles. If the amount of magnetic toner particles is smaller than 17% by number, the toner particles effective in enhancing image quality is insufficient. Particularly, as the toner particles are consumed in successive copying or print-out, the component of effective magnetic toner particles is decreased, and the balance in the particle size distribution of the magnetic toner shown by the present invention is deteriorated, whereby the image quality is gradually degraded. On the other hand, if the above-mentioned amount exceeds 60% by number, the magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a somewhat low density is liable to occur.

In the magnetic toner of the present invention, the amount of particles in the range of 8-12.7 microns is 1-23% by number, preferably 8-20% by number. If the above-mentioned amount is larger than 23% by number, not only the image quality deteriorates but also excess development (i.e., excess cover-up of toner particles) occurs, thereby to invite an increase in toner consumption. On the other hand, if the above-mentioned amount is smaller than 1%, it is difficult to obtain a high image density.

In the present invention, the percentage by number (N %) and that by volume (V %) of magnetic toner particles having a particle size of 5 micron or below may preferably satisfy the relationship of $N/V = -0.04N + k$, wherein k represents a positive number satisfying $4.5 \leqq k \leqq 6.5$. The number k may preferably satisfy $4.5 \leqq k \leqq 6.0$, more preferably $4.5 \leqq k \leqq 5.5$. Further, as described above, the percentage N satisfies $17 \leqq N \leqq 60$, preferably $25 \leqq N \leqq 50$, more preferably $30 \leqq N \leqq 50$.

If $k < 4.5$, magnetic toner particles of 5.0 microns or below are insufficient, and the resultant image density, resolution and sharpness decrease. When fine toner particles in a magnetic toner, which have conventionally been considered useless, are present in an appropriate amount, they attain closest packing of toner in development (i.e., in a latent image formed on a photosensitive drum) and contribute to the formation of a uniform image free of coarsening. Particularly, these particles fill thin-line portions and contour portions of an image, thereby to visually improve the sharpness thereof. If $k<4.5$ in the above formula, such a component becomes insufficient in the particle size distribution, the above-mentioned characteristics become poor. Further, in view of the production process, a large amount of fine powder must be removed by classification in order to satisfy the condition of $k<4.5$. Such a process is disadvantageous in yield and toner costs.

On the other hand, if $k>6.5$, an excess of fine powder is present, whereby the resultant image density is liable to decrease in successive copying. The reason for such phenomenon may be considered that an excess of fine magnetic toner particles having an excess amount of charge are triboelectrically attached to a developing sleeve and prevent normal toner particles from being carried on the developing sleeve and being supplied with charge.

In the magnetic toner of the present invention, the amount of magnetic toner particles having a particle size of 16 microns or larger is 2.0% by volume or less, preferably 1.0% by volume or less, more preferably 0.5% by volume or less.

If the above amount is more than 2.0% by volume, these particles impair thin-line reproducibility. In addition, toner particles of microns or larger are present as protrusions on the surface of the thin layer of toner particles formed on a photosensitive member by development, and they vary the transfer condition for the toner by disordering the delicate contact state between the photosensitive member and a transfer paper (or a transfer-receiving paper) by the medium of the toner layer. As a result, there occurs an image with transfer failure.

In the present invention, the volume-average particle size of the toner is 4–9 microns, preferably 4–8 microns. This value closely relates to the above-mentioned features of the magnetic toner according to the present invention. If the volume-average particle size is smaller than 4 microns tend to occur problems such that the amount of toner particles transferred to a transfer paper is insufficient and the image density is low, in the case of an image such as graphic image wherein the ratio of the image portion area to the whole area is high. The reason for such a phenomenon may be considered the same as in the above-mentioned case wherein the inner portion of a latent image provides a lower image density than that in the edge portion thereof. If the volume-average particle size exceeds 9 microns, the resultant resolution is not good and there tends to occur a phenomenon such that the image quality is lowered in successive use even when it is good in the initial stage thereof.

The particle distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution, and a volume-basis distribution and a personal computer CX-1 (available from Canon K.K.) are connected.

For measurement, a 1%-NaCl aqueous solution as an electrolytic solution is prepared by using a reagent-grade sodium chloride. Into 100 to 150 ml of electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. Form the results of the volume-basis distribution and number-basis distribution, parameters characterizing the magnetic toner of the present invention may be obtained.

It is preferred for the magnetic toner of the present invention to have a degree of aggregation of 40–95%, more preferably 50–90%, further preferably 50–80%. If the degree of aggregation is below 40%, the cleaning function on the photosensitive member in cooperation with the cleaning member is insufficient to cause a low slippage of the non-magnetic color toner particles through the cleaning member, thus tending to cause cleaning failure resulting in contamination of images. The cleaning failure is liable to occur particularly in a low humidity condition, but in order to provide good images even under various conditions for a long period of time, the degree of aggregation may preferably be 50% or higher. With respect to the abrasive function, if the degree of aggregation is below 40%, the abrasive function attained by appropriate attachment of the aggregated magnetic toner to the cleaning member and utilized in the present invention becomes insufficient, so that image defects are liable to occur with elapse of time due to filming on the photosensitive member or the deterioration or soiling of the photosensitive member surface.

If the degree of aggregation is above 95%, the toner is excessively aggregated in the cleaner, so that it becomes difficult to smoothly remove from the abutting position between the photosensitive member and the cleaning member to recover the toner in the cleaning unit. As a result, cleaning failure is liable to occur due to excessive accumulation of strongly aggregated toner.

The magnetic toner having a specific particle size distribution of the present invention does not cause excessive coverage of toner particles at the edge portion of a latent image and is excellent in transferability compared with a magnetic toner having a conventional particle size distribution, so that the amount of the toner remaining on the photosensitive member surface after the transfer is small and the amount of toner recovered in the cleaning unit is also small. The total amount of the toner supplied to the abutting position between the photosensitive member and the cleaning member and in the neighborhood thereof is considerably less than before. This provides an advantageous condition in respect of improvement in cleaning performance and abrasive function due to an appropriate degree of aggregation of the magnetic toner particles of the present invention having a relatively large agglomeration characteristic. In case where a toner having a large agglomeration characteristic is excessively applied to the neighborhood for the abutting position between the photosensitive member and the cleaning member, it becomes difficult to remove the toner from the neighborhood of the abutting position between the photosensitive member and cleaning member to recover it in the cleaning unit so that there are caused inconveniences such as excessive abrasion of the photosensitive member, damage of the photosensitive member or cleaning failure due to accumulation of excessively aggregated toner. Thus, it is necessary that the amount of toner supplied to the neighborhood of the abutting position between the photosensitive member and the cleaning member is relatively less than before.

The degree of aggregation of a toner can be measured by various methods. The degree of aggregation used herein is based on the values measured in the following manner. Incidentally, the toner used herein referred to toners both with and without containing silica fine powder or alumina fine powder externally added. Generally, a toner sample is placed on a sieve and subjected to vibration, followed by measurement of a proportion of the toner remaining on the sieve. According to this method, a larger percentage of toner remaining on the sieve indicates a larger degree of aggregation of the toner so that the toner particles are more ready to behave as a mass. More specifically, the measurement is effected by using a powder tester (available from Hosokawa Micron Mellitics Laboratory K.K.). A 60-mesh sieve having an opening of 250 microns (upper), a 100-mesh sieve having an opening of 149 microns (middle) and a 200-mesh sieve having an opening of 74 microns (lower) are arranged in this order from the above and set on a vibrating table. A toner in an amount of 2 g is placed on the 60-mesh sieve and is subjected to vibration for 40 seconds by applying a voltage of 47 V to the vibration system. After the completion of the vibration. The toner weights remaining on the respective sieves are measured and multiplied by factors (weights) of 0.5, 0.3 and 0.1, respectively, to provide a degree of aggregation in percentage.

In the present invention, the true density of the magnetic toner may preferably be 1.45–1.70 g/cm$^3$, more preferably 1.50–1.65 g/cm$^3$. When the true density is in such a range, the magnetic toner according to the present invention having a specific particle size distribution functions most effectively in view of high image quality and stability in successive use.

If the true density of the magnetic toner particles is smaller than 1.45, the weight of the particle per se is too light and there tend to occur reversal fog, and deformation of thin lines, scattering and deterioration in resolution because an excess of toner particles are attached to the latent image. On the other hand, the true density of the magnetic toner is larger than 1.70, there occurs an image wherein the image density is low, thin lines are interrupted, and the sharpness is lacking. Further, because the magnetic force becomes relatively strong in such a case, ears of the toner particles are liable to be lengthened or converted into a branched form. As a result, the image quality is disturbed in the development of a latent image, whereby a coarse image is liable to occur.

In the present invention, the true density of the magnetic toner is measured in the following manner which can simply provide an accurate value in the measurement of fine powder, while the true density can be measured in various manners.

There are provided a cylinder of stainless steel having an inner diameter of 10 mm and a length of about 5 cm, and a disk (A) having an outer diameter of about 10 mm and a height of about 5 mm, and a piston (B) having an outer diameter about 10 mm and a length of about 8 cm, which are capable of being closely inserted into the cylinder.

In the measurement, the disk (A) is first disposed on the bottom of the cylinder and about 1 g of a sample to be measured is charged in the cylinder, and the piston (B) is gently pushed into the cylinder. Then, a force of 400 Kg/cm$^2$ is applied to the piston by means of a hydraulic press, and the sample is pressed for 5 min. The weight (W g) of thus pressed sample is measured and the diameter (D cm) and the height (L cm) thereof are measured by means of a micrometer. Based on such a measurement, the true density may be calculated according to the following formula:

$$\text{True density } (g/cm^3) = W/(\pi \times (D/2)^2 \times L)$$

In order to obtain better developing characteristics, the magnetic toner of the present invention may preferably have the following magnetic characteristics: a remanences $\sigma_r$ of 1–5 emu/g, more preferably 2–4.5 emu/g; a saturation magnetization $\sigma_s$ of 20–40 emu/g; and a coercive force Hc of 40–100 Oe. These magnetic characteristics may be measured under a magnetic field for measurement of 1,000 Oe.

The binder constituting the toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumaroneindene resin and petroleum resin.

In a hot pressure roller fixing system using substantially no oil application, serious problems are caused by an offset phenomenon that a part of toner image on toner image-supporting member is transferred to a roller, and also in respect of an intimate adhesion of a toner on the toner image-supporting member. As a toner fixable with a less heat energy is generally liable to cause blocking or caking in storage or in a developing apparatus, this should be also taken into consideration. With these phenomenon, the physical property of a binder resin in a toner is most concerned. According to our study, when the content of a magnetic material in a toner is decreased, the adhesion of the toner onto the toner image-supporting member mentioned above is improved, while the offset is more readily caused and also the blocking or caking are also more liable. Accordingly, when a hot roller fixing system using almost no oil application is adopted in the present invention, selection of a binder resin becomes more serious. A preferred binder resin may for example be a crosslinked styrene copolymer, or a crosslinked polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ethers. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1, 3-butanediol diacrylate; divinyl compounds such as divinyl ether, divinyl sulfide and divinyl sulfone; and compounds having three or more vinyl groups. these compounds may be used singly or in mixture. In view of the fixability and anti-offset characteristic of the toner, the crosslinking agent may preferably be used in an amount of 0.01–10 wt. %, preferably 0.05–5 wt. %, based on the weight of the binder resin.

For a pressure-fixing system, a known binder resin for pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

In the magnetic toner and the non-magnetic color toner of the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge. As a result, when the charge controller is used in the present invention, it is possible to further clarify the above-mentioned functional separation and mutual compensation corresponding to the particle size ranges, in order to enhance the image quality.

Examples of the charge controller may include; nigrosine and its modification products modified by a fatty acid metal salt, quaternary ammonium salts, such as tributylbenzyl-ammonium-1 hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclo-hexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer having an amino group represents by the formula:

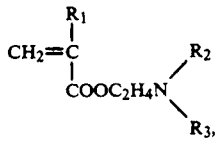

wherein $R_1$ represents H or $CH_3$; and $R_2$ and represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of a binder.

On the other hand, a negative charge controller can be used in the present invention. Examples thereof may include an organic metal complex or a chelate compound. More specifically there may preferably be used aluminum acetylacetonate, iron (II) acetylacetonate, and a 3,5-di-tertiary butylsalicylic acid chromium. There may more preferably be used acetylacetone complexes, or salicylic acid-type metal salts or complexes. Among these, salicylic acid-type complexes (inclusive of mono-alkyl-substituted compounds and di-alkyl substituted compounds) or metal salts (inclusive of mono-alkyl-substituted compounds and di-alkyl-substituted compounds) may particularly preferably be used.

It is preferred that the above-mentioned charge controller is used in the form of fine powder. In such a case, the number-average particle size thereof may preferably be 4 microns or smaller, more preferably 3 microns or smaller.

In the case of internal addition, such a charge controller may preferably be used in an amount of 0.1–20 wt. parts, more preferably 0.2–10 wt. parts, per 100 wt. parts of a binder resin.

It is preferred that silica fine powder is externally added to the magnetic toner and the non-magnetic color toner of the present invention.

In the magnetic toner of the present invention having the above-mentioned particle size distribution characteristic, the specific surface area thereof becomes larger than that in the conventional toner. In a case where the magnetic toner particles are caused to contact the surface of a cylindrical electroconductive non-magnetic sleeve containing a magnetic field-generating means therein in order to triboelectrically charge them, the frequency of the contact between the toner particle surface and the sleeve is increased as compared with that in the conventional magnetic toner, whereby the abrasion of the toner particles or the contamination of the sleeve is liable to occur. However, when the magnetic toner of the present invention is combined with the silica fine powder, the silica fine powder is disposed between the toner particles and the sleeve surface, whereby the abrasion of the toner particle is remarkably reduced.

Thus, the life of the magnetic toner and the sleeve may be extended and the chargeability may stably be retained. As a result, there can be provided a developer comprising a magnetic toner showing excellent characteristics in long-time use. Further, the magnetic toner particles having a particle size of 5 microns or smaller, which play an important role in the present invention, may produce a better effect in the presence of the silica fine powder, thereby to stably provide high-quality images.

The silica fine powder may be those produced through the dry process or the wet process. A silica fine powder produced through the dry process is preferred in view of the anti-filming characteristic and durability thereof.

The dry process referred to herein is a process for producing silica fine powder through vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

Commercially available fine silica powder formed by vapor-phase oxidation of a silicon halide to be used in the present invention include those sold under the trade names of AEROSIL (Nippon Aerosil Co.) 130, 200 and 300.

On the other hand, in order to produce silica powder to be used in the present invention through the wet process, various processes known heretofore may be applied. For example, decomposition of sodium silicate with an acid represented by the following scheme may be applied:

$$Na_2O.xSiO_2+HCl+H_2O \rightarrow SiO_2.nH_2O+NaCl.$$

In addition, there may also be used a process wherein sodium silicate is decomposed with an ammonium salt or an alkali salt, a process wherein an alkaline earth metal silicate is produced from sodium silicate and decomposed with an acid to form silicic acid, a process wherein a sodium silicate solution is treated with an ion-exchange resin to form silicic acid, and a process wherein natural silicic acid or silicate is utilized.

The silica power to be used herein may be anhydrous silicon dioxide (chloride silica), and also a silicate such as aluminum silicate, sodium silicate, potassium silicate, magnesium silicate and zinc silicate.

Commercially available fine silica powders formed by the wet process include one sold under the trade name of Nipsil (Nippon Silica K.K.).

Among the above-mentioned silica powders, those having a specific surface area as measured by the BET method with nitrogen adsorption of 30 $m^2/g$ or more, particularly 50–400 $m^2/g$, provide a good result. In the present invention, the silica fine powder may preferably be used in an amount of 0.01–5 wt. parts, more preferably 0.1–3 wt. parts, with respect to 100 wt. parts of the magnetic toner or the non-magnetic color toner, in view of improvement in fluidity and prevention of toner scattering.

It is advantageous that the silica fine powder has a charge polarity equal to that of the toner to which it is added. For example, in the case where a positively chargeable silica fine powder is added to a positively chargeable magnetic toner or non-magnetic color toner, not only the transfer is advantageously effected because of the same charge polarity but also a part of the silica fine powder isolated from the magnetic or non-magnetic toner is also transferred so that the toner recovered in the cleaning unit tends to contain less silica fine powder and have an increased aggregation characteristic. This advantageously affects the enhancement of cleaning performance and abrasion function on the photosensitive member surface exerted by the aggregation of the toner particles per se in the present invention.

On the other hand, in case where a silica fine powder having a charge polarity opposite to that the magnetic toner or non-magnetic color toner is added, the transfer of the silica fine powder becomes difficult so that the toner recovered in the cleaning unit is caused to contain more silica fine powder having a fluidity-imparting function to have a lower degree of aggregation. As a result, the effect of enhancing the cleaning performance and abrasive function exerted by the toner particles per se of the present invention can be weakened.

In case where the magnetic toner of the present invention is used as a positively chargeable magnetic toner, it is preferred to use positively chargeable fine silica powder rather than negatively chargeable fine silica powder, in order to prevent the abrasion of the toner particle and the soiling of the sleeve surface, and to retain the stability in chargeability.

In order to obtain positively chargeable silica fine powder, the above-mentioned silica powder obtained through the dry or wet process may be treated with a silicone oil having an organic group containing at least one nitrogen atom in its side chain, a nitrogen-containing silane coupling agent, or both of these.

In the present invention, "positively chargeable silica" means one having a positive triboelectric charge with respect to iron powder carrier when measured by the blow-off method.

The silicone oil having a nitrogen atom in its side chain to be used in the treatment of silica fine powder may be a silicone oil having at least the following partial structure:

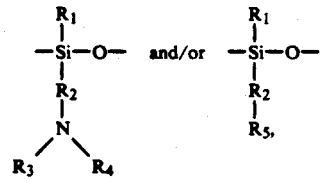

wherein $R_1$ denotes hydrogen, alkyl, aryl or alkoxyl; $R_2$ denotes alkylene or phenylene; $R_3$ and $R_4$ denote hydrogen, alkyl, or aryl; and $R_5$ denotes a nitrogen-containing heterocyclic group. The above alkyl, aryl, alkylene and phenylene group can contain an organic group having a nitrogen atom, or have a substituent such as halogen within an extent not impairing the chargeability. The above-mentioned silicone oil may preferably be used in an amount of 1–50 wt. %, more preferably 5–30 wt. %, based on the weight of the silica fine powder.

The nitrogen-containing silane coupling agent used in the present invention generally has a structure represented by the following formula:

$$R_mSiY_n,$$

wherein R is an alkoxy group or a halogen atom; Y is an amino group or an organic group having at least one amino group or nitrogen atom; and m and n are positive integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated and may respectively be known ones. Examples of the unsaturate heterocyclic ring structure providing the nitrogen-containing heterocyclic group may include the following:

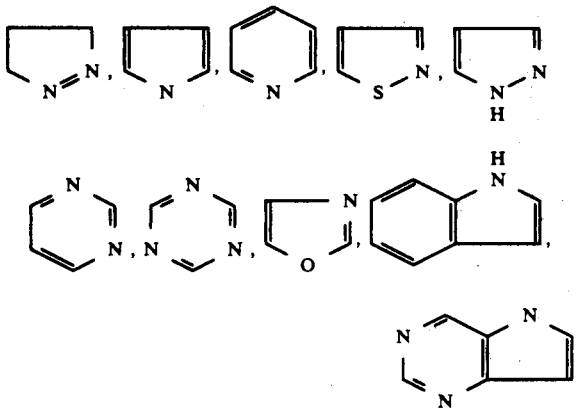

Examples of the saturated heterocyclic ring structure include the following:

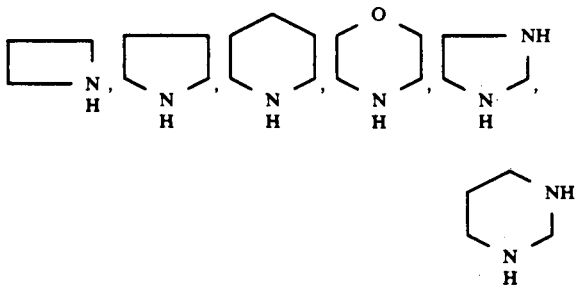

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrtimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-γ-propylphenylamine, and
trimethoxysilyl-γ-propylbenzyl-amine.
Further, examples of the nitrogen-containing heterocyclic compounds represented by the above structural formulas include:
trimethoxysilyl-γ-propylpiperidine,
trimethoxysilyl-γ-propylmorpholine, and
trimethoxysilyl-γ-propylimidazole.
The above-mentioned nitrogen-containing silane coupling agent may preferably be used in an amount of 1-50 wt. %, more preferably 5-30 wt. %, based on the weight of the silica fine powder.

The thus treated positively chargeable silica powder shows an effect when added in an amount of 0.01-8 wt. parts and more preferably may be used in an amount of 0.1-5 wt. parts, respectively with respect to the positively chargeable magnetic toner or non-magnetic color toner to show a positive chargeability with excellent stability. As a preferred mode of addition, the treated silica powder in an amount of 0.1-3 wt. parts with respect to 100 wt. parts of the positively chargeable magnetic a non-magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds. The above-mentioned treating agent may preferably be used in an amount of 1-40 wt. % based on the weight of the silica fine powder. However, the above treating agent may be used so that the final product of the treated silica fine powder shows positive chargeability.

An additive may be mixed in the magnetic toner or non-magnetic color toner of the present invention as desired. More specifically, as a colorant, known dyes or pigments may be used generally in an amount of 0.5-20 wt. parts per 100 wt. parts of a binder resin. Another optional additive may be added to the toner so that the toner will exhibit further better performances. Optional additives to be used include, for example, lubricants such as zinc stearate; abrasives such as cerium oxide and silicon carbide; flowability improvers such as colloidal silica and aluminum oxide; anti-caking agent; or conductivity-imparting agents such as carbon black and tin oxide.

In order to improve releasability in hot-roller fixing, it is also a preferred embodiment of the present invention to add to the magnetic toner a waxy material such as low-molecular weight polyethylene, low-molecular weight polypropylene, microcrystalline wax, carnauba wax, sasol wax or paraffin wax preferably in an amount of 0.5-5 wt. %.

The magnetic toner of the present invention contains a magnetic material, which may be one or a mixture of: iron oxides such as magnetite, hematite, ferrite and ferrite containing excess iron; metals such as iron, cobalt and nickel, alloys of these metals with metals such as aluminum, cobalt, copper, lead, magnesium, tin, zinc, antimony, beryllium, bismuth, cadmium, calcium, manganese, selenium, titanium, tungsten and vanadium.

These ferromagnetic materials may preferable be in the form of particles having an average particle size of the order of 0.1-1 micron, preferably 0.1-0.5 microns and be used in the toner in an amount of about 60-110 wt. parts, particularly 65-100 wt. parts, per 100 wt. parts of the resin component.

The magnetic toner for developing electrostatic images according to the present invention may be produced by sufficiently mixing magnetic powder with a vinyl on non-vinyl thermoplastic resin such as those enumerated hereinbefore, and optionally, a pigment or dye as colorant, a charge controller, another additive, etc., by means of a mixer such as a ball mill, etc.; then melting and kneading the mixture by hot kneading means such as hot rollers, kneader and extruder to disperse or dissolve the pigment or dye, and optional additives, if any, in the melted resin; cooling and crushing the mixture; and subjecting the powder product to precise classification to form magnetic toner according to the present invention.

The magnetic toner according to the present invention may preferably be applied to an image forming apparatus for practicing an image forming method using a magnetic toner developing means whereby a latent image is developed while toner particles are caused to fly from a toner-carrying member such as a cylindrical sleeve to a latent image carrying member such as a photosensitive member.

The magnetic toner is supplied with triboelectric charge mainly due to the contact thereof with the sleeve surface and applied onto the sleeve surface in a thin layer form. The thin layer of the magnetic toner is formed so that the thickness thereof is smaller than the clearance between the photosensitive member and the sleeve in a developing region. In the development of a latent image formed on the photosensitive member, it is preferred to cause the magnetic toner particles having triboelectric charge to fly from the sleeve to the photosensitive member, while applying an alternating electric field between the photosensitive member and the sleeve. Examples of the alternating electric field may include a pulse electric field, or an electric field based on an AC bias or a superposition of AC and DC biases.

A developing method using a one component magnetic developer is explained in more detail with reference to FIG. 7.

Figure 7:
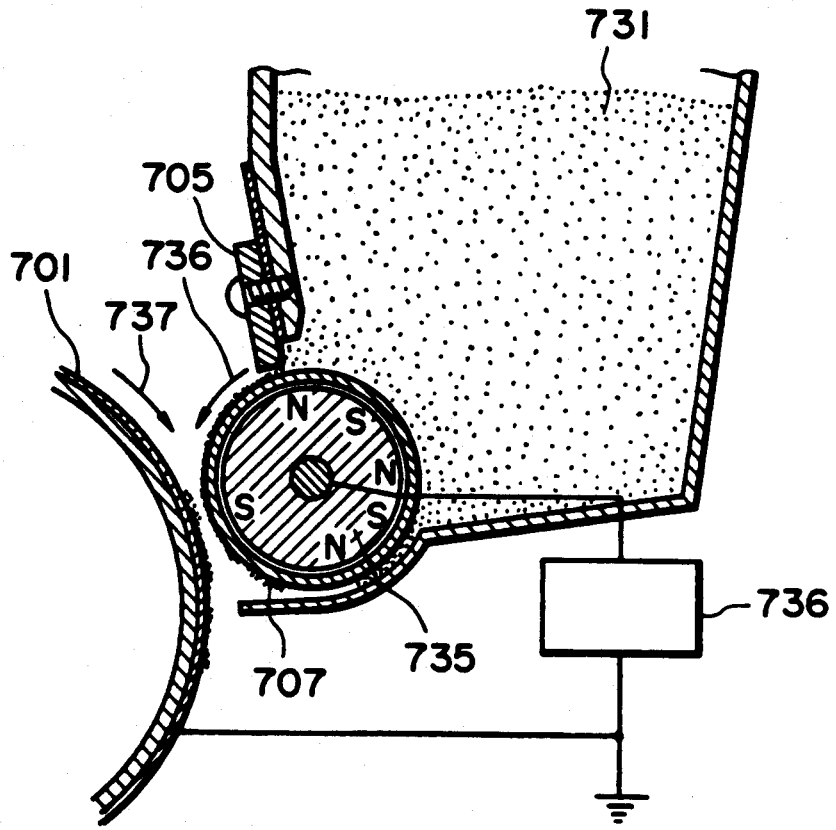
FIG. 7 is a schematic sectional view of an image forming apparatus capable of using a magnetic toner or a one-component magnetic developer according to the invention.

Referring to FIG. 7, a one component-type developer 731 applied in a thin layer on the surface of a stainless steel-made cylindrical sleeve 707 rotating in the direction of an arrow 736 by means of a magnetic blade 705 and is carried through a clearance between the sleeve 707 and the blade 705. The sleeve 707 contains inside therein a fixed magnet 735 as a magnetic field generating means, and the fixed magnet 735 formed a magnetic field in the neighborhood of the sleeve surface in a developing region where the sleeve surface faces close to a photosensitive drum 701 comprising an organic photoconductive layer having a negatively charged latent image. Between the photosensitive drum 701 rotating in the direction of an arrow 737 and the sleeve 707, a biasing voltage formed by superposition of an AC bias and a DC bias is applied.

The non-magnetic color toner of the present invention comprises a binder resin similar to that used in the above-mentioned magnetic toner and may further contain an additive as desired. The colorant contained in the non-magnetic toner may be a dye and/or a pigment known heretofore as a colorant and may for example be Phthalocyanine Blue, Peacock Blue, Permanent Red, Lake Red, Rhodamine Lake, Hansa Yellow, Permanent Yellow or Benzidine Yellow. The content of the colorant may be 0.5 to 20 wt. parts, and in order to provide an OHP (overhead projector) film having a good transparency, may preferably be 12 wt. parts or less, further preferably be 0.5 to 9 wt. parts, respectively per 100 wt. parts of the binder resin.

The carrier usable in the present invention may for example be powder having a magnetism, such as iron powder, ferrite powder or nickel powder, or such powder further coated with a resin. The carrier may be used in an amount of 10 to 1000 wt. parts, preferably 30-500 wt. parts, per 10 wt. parts of the toner. The carrier may preferably have a particle size of 4 to 100 microns, further preferably 10 to 60 microns, in view of the combination with a small particle size toner.

The non-magnetic color toner for developing electrostatic image according to the present invention may be produced by sufficiently mixing a vinyl or non-vinyl thermoplastic resin, a pigment or dye as a colorant, and optionally a charge controller, another additive, etc., by means of a mixer such as a ball mill, etc.; then melting and kneading the mixture by hot kneading means such as hot rollers, kneader and extruder to disperse or dissolve the pigment or dye, and optional additive, if any, in the melted resin; cooling and crushing the mixture; and subjecting the powder product to precise classification to form a non-magnetic toner according to the present invention.

In the non-magnetic color toner developing means according to the invention, a two-component type developer may be formed by the non-magnetic toner and magnetic particles and applied to an ordinary two-component type image forming method. It is particularly preferably applied to an image forming method, wherein a magnetic particle-confining member is disposed opposite to a toner-carrying member, a magnetic brush of magnetic particles is formed under the action of a magnetic force given by a magnetic field generating means inner region upstream of the magnetic particle confining member with respect to the moving direction of the surface of the toner-carrying member, to confine the magnetic brush by the magnetic particle-confining member, and form a thin layer of the non-magnetic toner on the toner-carrying member, and a latent image formed on a latent image-bearing member is developed with the non-magnetic toner under the application of an alternating electric field.

Figure 6A:
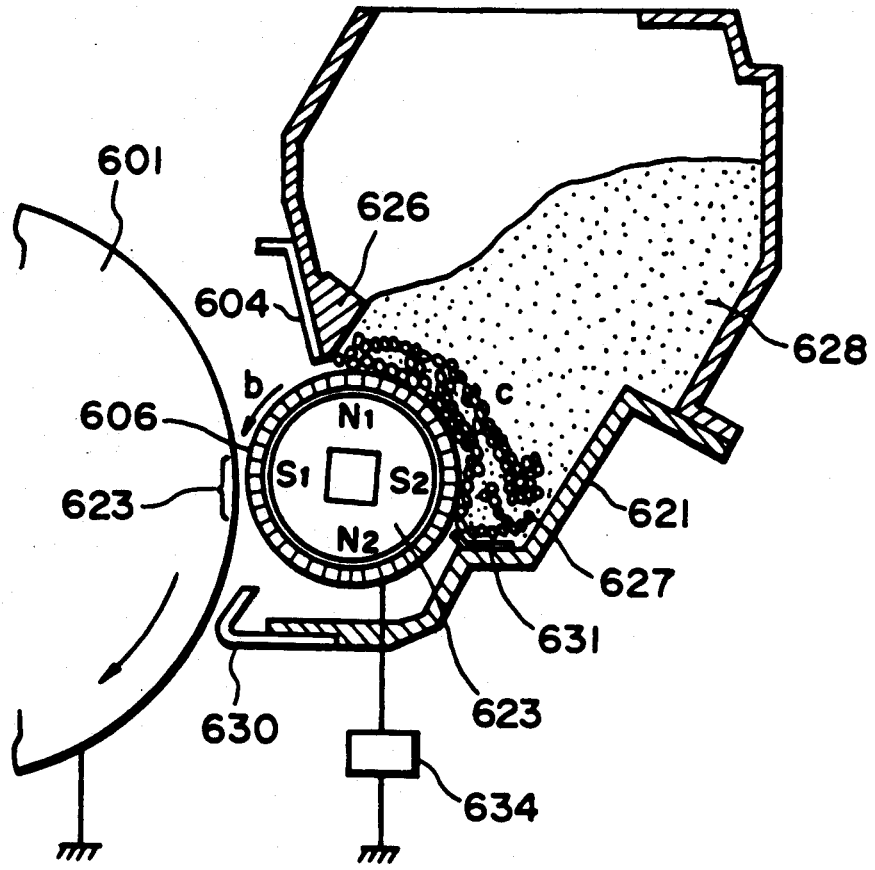
FIG. 6A is a schematic sectional view of an image forming apparatus capable of using a two-component developer including a non-magnetic color toner according to the invention.

The above-mentioned developing method is explained with reference to FIG. 6A. Referring to FIG. 6A, the apparatus comprising a latent image-bearing member 601, a developer supplying container 621, a non-magnetic sleeve 606, a fixed magnet 623, a magnetic or non-magnetic blade 604, a confining member for defining the region for circulating magnetic particles 626, magnetic particles 627, a non-magnetic toner 628, a scattering preventing member 630, a magnetic member 631, a developing region 632, and a biasing electric supply 634. The sleeve 606 rotates in the direction of B, and therewith, the magnetic particles 627 circulate in the direction of C. As a result, the sleeve surface contact and are rubbed with the magnetic particle layer to form a non-magnetic developer layer on the sleeve. While the magnetic particles circulate in the direction of C, a part thereof in a prescribed amount regulated by the clearance between the magnetic or non-magnetic blade 604 and the sleeve 606 is applied on the non-magnetic developer layer. As a result, the non-magnetic toner is applied on both the sleeve surface and the surface of magnetic particles, so that it is possible to obtain an effect substantially the same as given by an increase in sleeve surface area. In the developing region 632, one magnetic pole of the fixed magnet 623 is directed to the latent image surface to form a clear development pole, and the non-magnetic toner is caused to fly for development from the sleeve and the magnetic particles under the action of an alternating electric field. After the development, the magnetic particles and yet unused developer are moved along with the rotation of the sleeve to be recovered in the developer container.

Figure 6B:
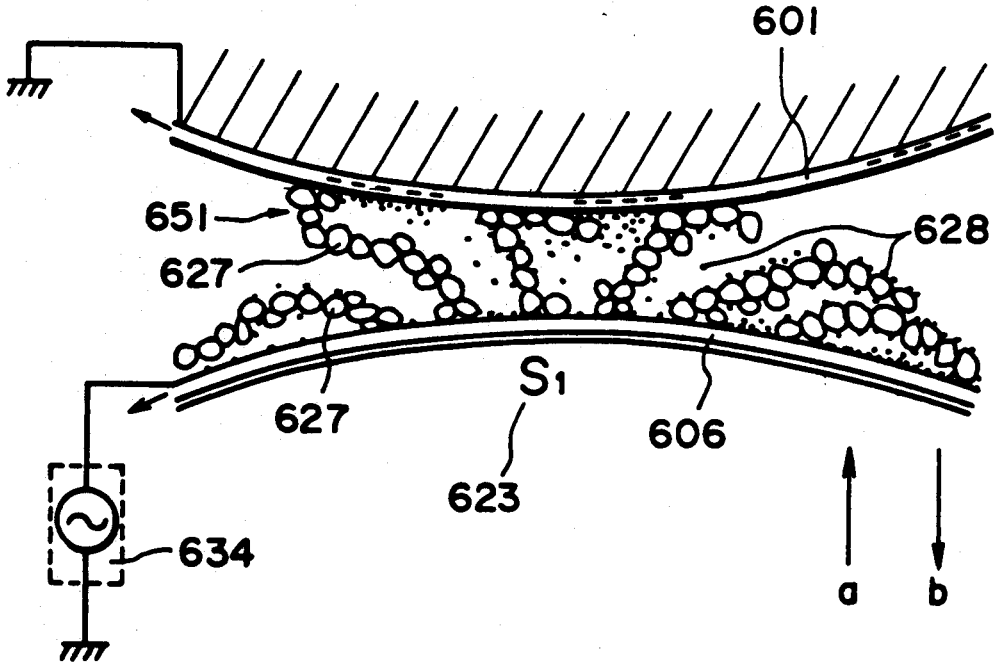
FIG. 6B is a partially enlarged sectional view of the developing station.

The development phenomenon is explained in more detail with reference to FIG. 6B. The electrostatic latent image is composed by a negative charge (dark image part) to form an electric field in the direction of an arrow a. The electric field direction given by the alternating electric field alternates with time, but in a phase when a positive component is applied to the sleeve 606 side, the electric field direction given thereby coincides with the electric field direction given by the latent image. At this time, the amount of charge injected to ears 651 by the electric field becomes the largest, so that the ears 651 assume the maximum standing position as shown in the Figure to reach the surface of the photosensitive drum 601.

On the other hand, the non-magnetic toner 628 on the surfaces of the sleeve 606 and the magnetic particles 627 is positively charged as described above, and is therefore transferred to the photosensitive drum 601 by the electric field formed in the space. At this time, the ears 651 stand in a coarse state, the surface of the sleeve 606 is exposed, and the toner 628 is released from the surfaces of both the sleeve 606 and the ears 651. In addition, as the ears 651 are provided with charge of the same polarity as the toner 628, the toner 628 on the surface of the ears 651 is further easily released by the action of electric repulsion.

In a phase when a negative component of the alternating voltage is applied to the sleeve 606, the electric field in the direction of an arrow b given by the alternating voltage is opposite to the electric field direction A given by the negative latent image. As a result, the electric field in the space is weakened and the amount of charge injection is decreased, so that the ears 651 form a contact state shrinked corresponding to the amount of charge injection.

On the other hand, the toner 628 on the photosensitive drum 608 is positively charged as described above, and is therefore reversely transferred to the sleeve 606 or the magnetic particles 627 under the action of the electric field formed in the space. In this way, the toner 628 is moved reciprocally between the photosensitive drum 603 and the sleeve 622 surface or the surface of the magnetic particles 627. Consequently, as the photosensitive drum 601 and the sleeve 606 rotate, the space between these members is expanded and the electric field is weakened to complete the developing action.

The ears 651 are provided with a charge such as triboelectric charge or mirror-image charge given by the toner 628, a charge given by the electrostatic latent image on the photosensitive drum 601 and the charge injected by the alternating electric field between the photosensitive drum 601 and the sleeve 606, and the charge state is changed according to the time constant of charge and discharge determined by the material of the magnetic particles 627 and other factors.

As described above, the ears 651 of the magnetic particles 627 assume a minute but vigorous vibrating state under the action of the alternating electric field as described above.

After the development, the magnetic particles and yet unused toner particles are carried along with the rotation of the sleeve and recovered in the developer container.

The sleeve 606 can be formed from a cylinder of paper or a synthetic resin. By treating the surface of such a cylinder to provide an electroconductivity or by using a cylinder of an electroconductive material such as aluminum, bronze or stainless steel, a development electrode roller may be provided.

Incidentally, in the present invention, the thin-line reproducibility may be measured in the following manner.

An original image comprising thin lines accurately having a width of 100 microns is copied under a suitable copying condition, i.e., a condition such that a circular original image having a diameter of 5 mm and an image density of 0.3 (halftone) is copied to provide a copy image having an image density of 0.3–0.5, thereby to obtain a copy image as a sample for measurement. An enlarged monitor image of the sample is formed by means of a particle analyzer (Luzex 450, mfd. by Nihon Regulator Co. Ltd.) as a measurement device, and the line width is measured by means of an indicator. Because the thin line image comprising toner particles has unevenness in the width direction, the measurement points for the line width are determined so that they correspond to the average line width, i.e., the average of the maximum and minimum line widths. Based on such a measurement, the value (%) of the thin-line reproducibility is calculated according to the following formula:

$$\frac{\text{Line width of copy image obtained by the measurement}}{\text{Line width of the original (100 microns)}} \times 100$$

Further, in the present invention, the resolution may be measured in the following manner.

There are formed ten species of original images comprising a pattern of five thin lines which have equal line width and are disposed at equal spacings equal to the line width. In these ten species of original images, thin lines are respectively drawn so that they provide densities of 2.8, 3.2, 3.6, 4.0, 4.5, 5.0, 5.6, 6.3, 7.1, and 8.0 lines per 1 mm. These ten species of original images are copied under the above-mentioned suitable copying conditions to form copy images which are then observed by means of a magnifying glass. The value of the resolution is so determined that it corresponds to the maximum number of thin lines (lines/mm) of an image wherein all the thin lines are clearly separated from each other. As the above-mentioned number is larger, it indicates a higher resolution.

Hereinbelow, the present invention will be described in further detail with reference to Examples, by which the present invention are not intended to be limited at all. In the following Examples, "parts" used for expressing a composition are by weight.

EXAMPLE 1

| | |
|---|---|
| Styrene/butyl acrylate/divinylbenzene copolymer (copolymerization wt. ratio: 80/19.5/0.5, weight-average molecular weight: 320,000) | 100 wt. parts |
| Tri-iron tetraoxide (average particle size = 0.2 micron) | 80 wt. parts |
| Nigrosin (number-average particle size = about 3 microns) | 4 wt. parts |
| Low-molecular weight propylene-ethylene copolymer | 4 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfd. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (magnetic toner) having a number-average particle size of 7.4 microns. When the thus obtained black fine powder was mixed with iron powder carrier and thereafter the triboelectric charge thereof was measured, it showed a value of +8 μC/g.

The number-basis distribution and volume-basis distribution of the thus obtained magnetic toner of positively chargeable black fine powder were measured by means of a Coulter counter Model TA-II with a 100 micron-aperture in the above-described manner. The thus obtained results are shown in the following Table 1. Thus, the magnetic toner showed the values of N (value of % by number of particles having a size of 5 microns or smaller), V (value of % by weight of the particles having a size of 5 microns or smaller) and ratio N/V as follows: N=35%, V=10%, and N/V=3.5.

TABLE 1

| Size (μm) | Number of particles | % by number (N) Distribution | % by number (N) Accumulation | % by volume (V) Distribution | % by volume (V) Accumulation |
|---|---|---|---|---|---|
| 2.00–2.52 | 2374 | 2.3 | 2.3 | 0.0 | 0.0 |
| 2.52–3.17 | 4351 | 4.2 | 6.6 | 0.4 | 0.4 |
| 3.17–4.00 | 9556 | 9.3 | 15.9 | 1.9 | 2.3 |
| 4.00–5.04 | 20048 | 19.5 | 35.4 | 8.1 | 10.3 |
| 5.04–6.35 | 26486 | 25.8 | 61.3 | 19.7 | 30.0 |
| 6.35–8.00 | 25686 | 25.0 | 86.3 | 35.1 | 65.1 |
| 8.00–10.08 | 12200 | 11.9 | 98.2 | 27.2 | 92.3 |
| 10.08–12.70 | 1815 | 1.8 | 99.9 | 7.2 | 99.5 |
| 12.70–16.00 | 66 | 0.1 | 100.0 | 0.5 | 100.0 |
| 16.00–20.20 | 5 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Figure 8:
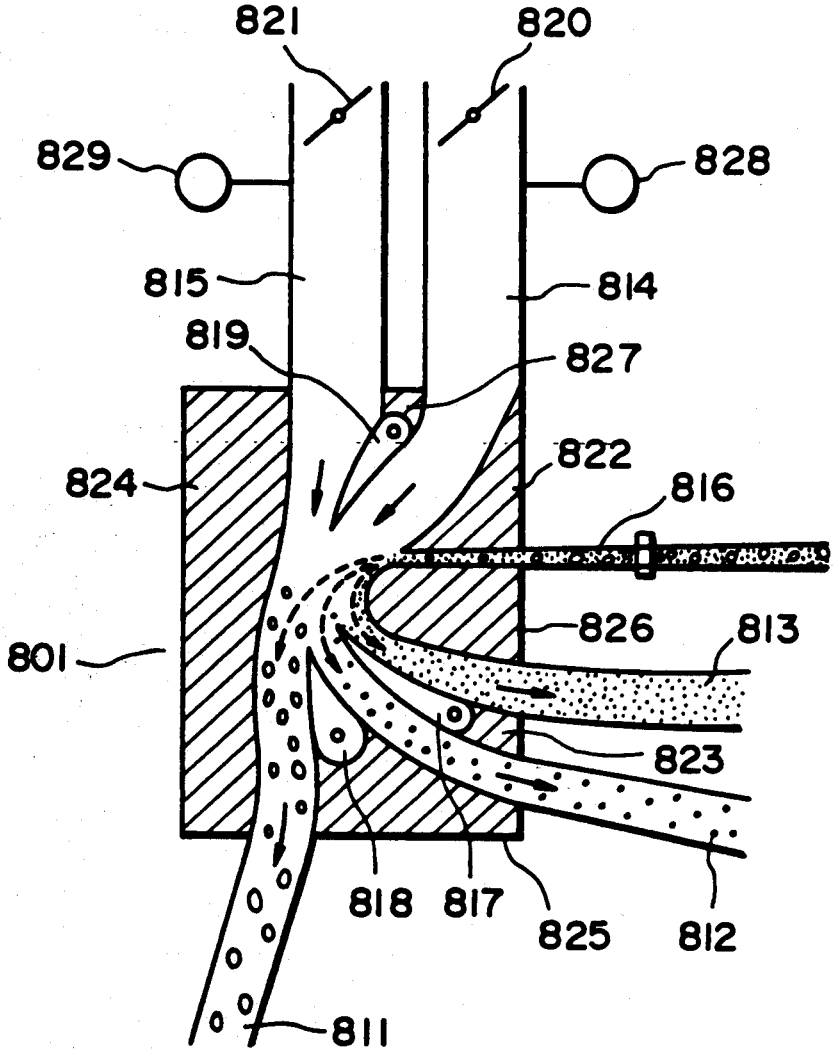
FIG. 8 is a view for illustrating a classification step using a multi-division classification means.
Figure 9:
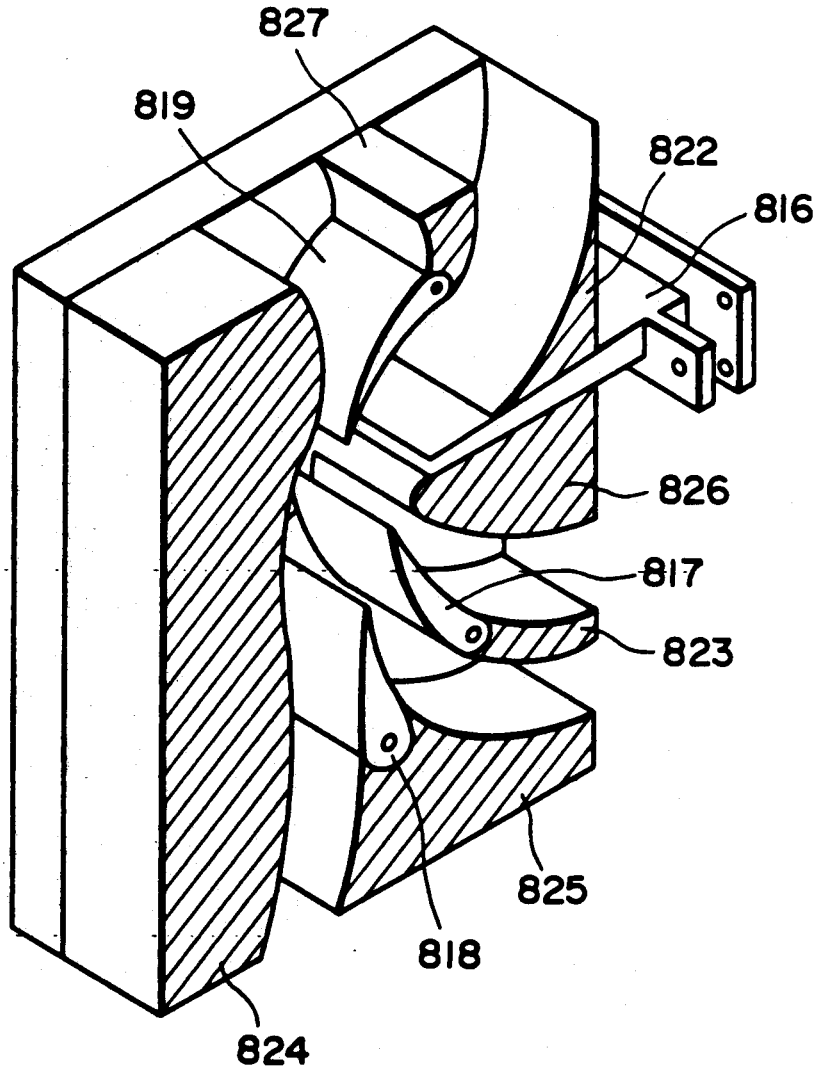
FIG. 9 is a schematic perspective view showing a section of the multi-division classification means.

For reference, FIG. 8 schematically shows the classification step using the multi-division classifier, and FIG. 9 shows a sectional perspective view of the multi-division classifier.

0.5 wt. part of positively chargeable hydrophobic dry process silica (BET specific surface area: 200 $m^2/g$) was added to 100 wt. parts of the magnetic toner of black fine powder obtained above and mixed therewith by means of a Henschel mixer thereby to obtain a positively chargeable one-component developer comprising a magnetic toner (a toner with silica externally added).

The degree of aggregation of the magnetic developer was measured to be 65%.

The above-mentioned magnetic toner showed a particle size distribution and various characteristics as shown in Table 3 appearing hereinafter.

A non-magnetic color toner was prepared in the following manner.

| | |
|---|---|
| Styrene-butyl acrylate/dimethylaminoethyl acrylate copolymer (copolymerization wt. ratio: 84/13/3, weight-average molecular weight: 230,000) | 100 wt. parts |
| Low-molecular weight polypropylene | 5 wt. parts |
| Azo-type red pigment | 5 wt. parts |

The above ingredients were well blended in a Henschel mixer and melt-kneaded at 150° C. by means of a two-axis extruder. The kneaded product was cooled, coarsely crushed by a cutter mill, finely pulverized by means of a pulverizer using jet air stream, and classified by a wind-force classifier to obtain a classified red powder product (non-magnetic toner). The red powder (non-magnetic toner) showed a volume-average particle size of 12.5 microns, and 100 wt. parts thereof was blended with 0.5 wt. part of positively chargeable hydrophobic silica to obtain a non-magnetic color toner (with silica externally added). The non-magnetic color toner (with silica) showed a degree of aggregation of about 35%. Then, 9 wt. parts of the non-magnetic color toner was blended with 100 wt. parts of magnetic ferrite carrier coated with fluorine/acrylic resin (average particle size: about 55 microns) to obtain a two-component developer.

The above prepared one-component developer and two-component developer were charged in an image forming (developing) device as shown in FIGS. 1 and 2, and a developing test was conducted. The developing conditions used in this instance are explained with reference to FIGS. 1 and 2.

The two-component developer was used for development in the following manner. Referring to FIG. 1, the non-magnetic color toner developing unit 2 was more specifically one shown in FIG. 6A, and the photosensitive drum 1 (or 601) was rotated at a peripheral speed of 100 mm/sec. in the direction of an arrow a. The stainless sleeve 6 (or 606) having an outer diameter of 20 mm was rotated in the direction of an arrow b at a peripheral speed of 150 mm/sec.

On the other hand, inside the rotating sleeve 6, a fixed magnet 623 (of sintered ferrite) was disposed to form a development magnetic pole providing a maximum surface magnetic flux density of about 980 Gauss. The magnetic blade 4 (or 604) was composed of a non-magnetic stainless steel plate having a thickness of 1.2 mm. The blade-sleeve spacing was 400 microns.

Opposite the sleeve 6 was disposed an OPC photosensitive drum having thereon an electrostatic latent image comprising a charge pattern having a dark part potential of −600 V and a light part potential of −150 V with a spacing of 350 microns from the sleeve surface.

The development was effected by applying an alternating voltage with a frequency of 1800 Hz, a peak-to-peak value of 1300 V and a central value of −200 V.

Then, the above-prepared one-component magnetic developer was used for development in the following manner. Referring to FIG. 2, the magnetic toner developing unit 3 was more specifically one shown in FIG. 7, and the one-component developer 3 was applied in a thin layer form onto the surface of a cylindrical sleeve 7 (or 707) of stainless steel as a toner-carrying means rotating in the direction of an arrow 736 by means of a magnetic blade 5 (or 705) as a means for forming the layer of the toner. The clearance between the sleeve 7 and the blade 5 was set to about 250 microns. The sleeve 7 contained a fixed magnet 735 as a magnet means. The fixed magnet 735 produced a magnetic field of 1000 gauss in the neighborhood of the sleeve surface in the developing region where the sleeve 7 was disposed near and opposite to a photosensitive drum 1, as an electrostatic image-bearing means, comprising an organic photoconductor layer carrying a negative latent image. The minimum space between the sleeve 7 and the photosensitive drum 1 rotating in the direction of an arrow 747 was set to about 300 microns. In the development, a bias of 2000 Hz/1350 Vpp obtained by superposing an AC bias and a DC bias was applied between the photosensitive drum 1 and the sleeve by an alternating electric field-applying means 736. The layer of the one-component developer formed on the sleeve 7 had a thickness of about 75–150 microns, and the magnetic toner formed ears having a height of about 95 microns under the magnetic field, due to the fixed magnet 735. By using the above-mentioned device, a negative latent image formed on the photosensitive drum 1 was developed by causing the one-component developer 3 having a positive triboelectric charge to fly to the latent image.

A developed red toner image was formed by the two-component developer on a half area of an A4-sized copying paper (plain paper) and fixed by heat-pressure rollers. Then, on the remaining half area, a black toner image was formed by the one-component magnetic developer and fixed by heat-pressure rollers. As a result, a fixed image of two-color images was formed on the copying paper. The above-image formation test was successively repeated 10000 times to form 10000 sheets of toner images. The results are shown in Table 4.

As apparent from Table 4, both of the line portion and large image area portion of the letters formed by the magnetic toner showed a high image density. The magnetic toner of the present invention was excellent in thin-line reproducibility and resolution, and retained good image quality in the initial stage and also after 10,000 sheets of image formation. Further, the copying cost per one sheet was low, whereby the magnetic toner of the present invention was excellent in economical characteristic.

Further, in the apparatus shown in FIG. 1, a felt pad was disposed in contact with the photosensitive drum between the cleaning blade 12 and the primary charger 10 so as to collect a toner leaked through the cleaning unit due to cleaning failure, whereby almost no color was observed on the pad and the weight increase was very small as 0.3 mg/1000 sheets.

The cleaning blade was composed of polyurethane rubber and has a thickness of 2.0 mm and a JIS A rubber hardness of 65 degrees. The blade was pushed against the photosensitive drum at a pressure of 10 g/cm. The cleaning roller was composed of polyurethane rubber.

Hereinbelow, the multi-division classifier and the classification step used in this instance are explained with reference to FIGS. 8 and 9.

Referring to FIGS. 8 and 9, the multi-division classifier has side walls 822, 823 and 824, and a lower wall 825. The side wall 823 and the lower wall 825 are provided with knife edge-shaped classifying wedges 817 and 818, respectively, whereby the classifying chamber is divided into three sections. At a lower portion of the side wall 822, a feed supply nozzle 816 opening into the classifying chamber is provided. A Coanda black 826 is disposed along the lower tangential line of the nozzle 816 so as to form a long elliptic arc shaped by bending the tangential line downwardly. The classifying chamber has an upper wall 827 provided with a knife edge-shaped gas-intake wedge 819 extending downwardly. Above the classifying chamber, gas-intake pipes 814 and 815 opening into the classifying chamber are provided. In the intake pipes 814 and 815, a first gas introduction control means 820 and a second gas introduction control means 821, respectively, comprising, e.g., a damper, are provided; and also static pressure gauges 828 and 829 are disposed communicatively with the pipes 814 and 815, respectively. At the bottom of the classifying chamber, exhaust pipes 811, 812 and 813 having outlets are disposed corresponding to the respective classifying sections and opening into the chamber.

Feed powder to be classified is introduced into the classifying zone through the supply nozzle 816 under reduced pressure. The feed powder thus supplied are caused to fall along curved lines 830 due to the Coanda effect given by the Coanda block 826 and the action of the streams of high-speed air, so that the feed powder is classified into coarse powder 811, black fine powder 812 having prescribed volume-average particle size and particle size distribution, and ultra-fine powder 813.

EXAMPLE 2

The same evaluation as in Example 1 was conducted except that the magnetic toner used in Example 1 was replaced by a magnetic toner which was prepared by changing the amount of magnetic powder and controlling the pulverization and classification conditions and showed various properties as shown in Table 3. As a result, no inconvenience such as cleaning failure or filming phenomena on the photosensitive member was observed, and as shown in Table 4, clear high quality images were stably obtained. The magnetic toner showed the following values: N=46%, V=14%, and N/V=3.3.

EXAMPLE 3

The same evaluation as in Example 1 was conducted except that the magnetic toner used in Example 1 was replaced by a magnetic toner showing various properties shown in Table 3. As a result, similarly as in Example 1 as shown in Table 4, clear high-quality images were obtained stably with good cleaning characteristics and durability. The magnetic toner showed the following values: N=20%, V=4%, and N/V=5.0.

to satisfy the conditions defined by the present invention.

The particle size distribution of the obtained magnetic toner is shown in Table 2. The magnetic toner showed the following values: N=9%, V=0.62%, and N/V=14.5.

TABLE 2

| Size (μm) | Number of particles | % by number (N) Distribution | % by number (N) Accumulation | % by volume (V) Distribution | % by volume (V) Accumulation |
|---|---|---|---|---|---|
| 2.00–2.52 | 992 | 1.4 | 1.4 | 0.0 | 0.0 |
| 2.52–3.17 | 1035 | 1.4 | 2.8 | 0.0 | 0.0 |
| 3.17–4.00 | 1210 | 1.7 | 4.5 | 0.0 | 0.0 |
| 4.00–5.04 | 3093 | 4.3 | 8.8 | 0.6 | 0.6 |
| 5.04–6.35 | 3189 | 11.4 | 20.3 | 3.2 | 3.8 |
| 6.35–8.00 | 15353 | 21.4 | 41.7 | 10.8 | 14.7 |
| 8.00–10.08 | 19040 | 26.6 | 68.3 | 21.5 | 36.1 |
| 10.08–12.70 | 15920 | 22.2 | 90.5 | 33.7 | 69.9 |
| 12.70–16.00 | 6161 | 8.6 | 99.1 | 25.8 | 95.7 |
| 16.00–20.20 | 584 | 0.8 | 100.0 | 4.3 | 100.0 |
| 20.20–25.40 | 25 | 0 | 100.0 | 0.0 | 100.0 |
| 25.40–32.00 | 1 | 0 | 100.0 | 0.0 | 100.0 |
| 32.00–40.30 | 0 | 0 | 100.0 | 0.0 | 100.0 |
| 40.30–50.80 | 0 | 0 | 100.0 | 0.0 | 100.0 |

EXAMPLE 4

The developing unit using the positively chargeable one-component magnetic developer prepared in Example 1 was applied to a digital copier NP9330 (available from Canon K.K.) having an amorphous silicon photosensitive drum to effect development, and further was replaced by the developing unit using the two-component type developer used in Example 1 to effect development, whereby a positively charged electrostatic image was developed by the reversal development system in the manner shown in FIG. 3 to effect 10,000 sheets of image formation. As shown in Table 4, clear images having a good gradation characteristic were produced with excellent thin line reproducibility and resolution. Further, good cleaning performance was obtained and substantially no cleaning failure with non-magnetic color toner was observed.

EXAMPLE 5

A black fine powder (magnetic toner) shown in Table 4 was prepared in the same manner as in Example 1, and 100 wt. parts of the black fine powder was mixed with 0.6 wt. part of a positively chargeable hydrophobic silica to form a positively chargeable one component magnetic developer (magnetic toner with externally added silica). The thus obtained one-component magnetic developer was evaluated in the same manner as in Example 1. The results are shown in Table 4. The magnetic toner showed the following values: N=57%, V=21.9%, and N/V=2.6.

COMPARATIVE EXAMPLE 1

Black fine powder (magnetic toner) as shown in Table 3 was prepared in the same manner as in Example 1 except that two of the fixed-wall type wind-force classifier used in Example 1 were used for the classification instead of the combination of the fixed-wall type wind-force classifier and the multi-division classifier as used in Example 1. The magnetic toner of Comparative Example 1 in the form of black fine powder showed the value of % by number of the magnetic toner particles having a particle size of 5 microns or smaller which was less than the range defined by the present invention and a volume-average particle size which was larger than the range defined by the present invention, thus failing 0.5 wt. part of positively chargeable hydrophobic dry process silica was blended with 100 wt. parts of the magnetic toner of black fine powder obtained above mixed therewith in the same manner as in Example 1 thereby to obtain a one-component developer. The thus obtained one-component developer was used together with the two-component developer containing a non-magnetic color toner used in Example 1 and subjected to image formation tests under the same conditions as in Example 1.

As a result, soiling or contamination of images due to cleaning failure was observed during the image formation. The degree of soiling was measured in the same manner as in Example 1, whereby the increase in weight of the felt pad due to soiling was 19 mg/1000 sheets.

Referring to FIG. 7, the height of ears formed in the developing region of the sleeve 707 was about 165 microns which was longer than that in Example 1. In the resultant images, the toner particles remarkably protruded from the latent image formed on the photosensitive member, the thin-line reproducibility was 135% which was poorer than that in Example 1, and the resolution was 4.5 lines/mm. Further, after 1000 sheets of image formation, the image density in the solid black pattern decreased and the thin-line reproducibility and resolution deteriorated. Moreover, the toner consumption was large.

The results are shown in Table 4 appearing hereinafter.

COMPARATIVE EXAMPLE 2

Evaluation was conducted in the same manner as in Example 1 except that a magnetic toner as shown in Table 3 was used instead of the magnetic toner used in Example 1.

As a result, poorer results were obtained in all respects of image density, resolution and thin-line reproducibility. The ears of the toner on the sleeve as a toner-carrying member in the developing unit were long and coarsely present, so that when the toner was caused to fly onto the photosensitive member, the toner provided a tailing protruding out of the latent image and also caused other inconveniences inclusive of scattering of the toner and a decrease in image density due to coarse coverage with toner particles.

After 2000 sheets of image formation, the soiling of images at the periphery of images was caused similarly as in Comparative Example 1, and after 1000 sheets of image formation, the image soiling was extended to the entirety to provide poor images. Further, similar cleaning failure as in Comparative Example 1 was observed. The magnetic toner showed the following values: N=12%, V=4.6%, and N/V=2.6.

TABLE 3

| | (Properties of toner) | | | | | | | | |
|---|---|---|---|---|---|---|---|---|---|
| | Particle size distribution | | | | Degree of | | Magnetic properties | | |
| | % by number ≦5 μm | % by volume ≧16 μm | % by number 8.0–12.7 μm | volume-ave. size μm | aggregation % | True density g/cm³ | Saturation magnification σs emu/g | Remanence σr emu/g | Coercive force Hc Oe |
| Ex. 1 | 35 | 0.0 | 14 | 7.4 | 65 | 1.56 | 27 | 3.2 | 91 |
| 2 | 46 | 0.3 | 11 | 6.5 | 74 | 1.69 | 38 | 4.2 | 92 |
| 3 | 20 | 0.5 | 23 | 8.5 | 60 | 1.51 | 25 | 2.8 | 90 |
| 4 | 35 | 0.3 | 14 | 7.4 | 65 | 1.56 | 27 | 3.2 | 91 |
| 5 | 57 | 0.2 | 10 | 5.7 | 71 | 1.62 | 31 | 3.7 | 90 |
| Comp. Ex. 1 | 9 | 4.3 | 49 | 11.3 | 41 | 1.43 | 22 | 2.3 | 90 |
| 2 | 12 | 0.2 | 56 | 9.5 | 33 | 1.43 | 24 | 1.4 | 49 |

TABLE 4

| | (Performances) | | | | | | | | |
|---|---|---|---|---|---|---|---|---|---|
| | Initial stage | | | | After 10000 sheets of image formation | | | | Toner |
| | Dmax 5φ | Dmax solid black | Thin line reproducibility | Resolution lines/mm | Dmax 5φ | Dmax solid black | Thin-line reproducibility | Resolution lines/mm | consumption g/sheet |
| Ex. 1 | 1.32 | 1.32 | 105% | 6.3 | 1.36 | 1.35 | 104% | 6.3 | 0.032 |
| 2 | 1.34 | 1.32 | 102 | 6.3 | 1.37 | 1.37 | 102 | 6.3 | 0.030 |
| 3 | 1.31 | 1.30 | 108 | 5.6 | 1.33 | 1.32 | 110 | 5.6 | 0.033 |
| 4 | 1.38 | 1.38 | 100 | 7.1 | 1.40 | 1.40 | 100 | 7.1 | 0.035 |
| 5 | 1.34 | 1.30 | 109 | 5.6 | 1.34 | 1.29 | 115 | 5.6 | 0.030 |
| Comp Ex. 1 | 1.31 | 1.30 | 135 | 4.5 | 1.31 | 1.25 | 150 | 4.0 | 0.055 |
| 2 | 1.19 | 1.12 | 135 | 4.0 | — | — | — | — | — *1 |

*1: In Comparative Example 2, image evaluation was difficult because of cleaning failure on the entire area.

EXPERIMENTAL EXAMPLE

A one-component developer prepared in Example 1 was charged in a developing unit as shown in FIG. 7, and a developing test was conducted. The developing conditions are explained with reference to FIG. 7.

The one component developer 731 was applied in a thin layer onto the surface of a cylindrical sleeve 707 of a stainless steel rotating in the direction of an arrow 736 by means of a magnetic blade 705. The clearance between the sleeve 707 and the blade 705 was set to about 250 microns. The sleeve 707 contained a fixed magnet 735 as a magnetic field generating means inside thereof. The fixed magnet 735 produced a magnetic field of 1000 Gauss in the neighborhood of the sleeve surface in the developing region where the sleeve 707 closely faced an OPC photosensitive drum 701 comprising an organic photoconductive layer having a negatively charged latent image thereon. The photosensitive drum 701 rotating in the direction of an arrow 737 and the sleeve 707 were disposed to provide a minimum distance of about 300 microns. Between the OPC photosensitive drum 701 and the sleeve 707, a biasing voltage of 2000 Hz/1350 Vpp formed by superposition of an AC bias and a DC bias. The one-component developer on the sleeve 733 was formed in a layer thickness of about 75 to 150 microns, and the magnetic toner formed ears with a height of about 95 microns in the developing region.

A negatively charged latent image formed on the OPC photosensitive drum 707 was developed by flying one-component magnetic developer 731 having a positive triboelectric charge. Such an image formation test was repeated 10,000 times to form 10,000 sheets of toner images.

As a result, line images such as characters and large area images both showed a high image density with excellent thin-line reproducibility and resolution. Even after the 10,000 sheets of image formation, no image defects due to cleaning failure or filming on the photosensitive member were observed, and the good image quality at the initial stage was maintained.

What is claimed is:

1. An image forming apparatus, comprising:

an electrostatic image-bearing member for holding an electrostatic latent image; a magnetic toner-developing means comprising a first developer disposed thereon for developing an electrostatic latent image having a magnetic toner to form a magnetic tonerr image on the electrostatic image-bearing member, wherein the magnetic toner contains 17 to 60% by number of magnetic toner particles having a particle size of 5 microns or smaller, 1–23% by number of magnetic toner particles having a particle size of 8.0–12.7 microns and 2.0% by volume or less of magnetic toner particles having a size of 16 microns or larger, wherein the magnetic toner has a volume-average particle size of 4–9 microns and a degree of aggregation of 50–95%, and wherein the magnetic toner has a particle size distribution satisfying the following formula:

$$N/V=0.04N+k,$$

where N denotes the value of % by number of magnetic particles having a size of 5 microns or smaller, namely a positive number of 17 to 60, V denotes the value of % by volume of magnetic particles having a size of 5 microns or smaller, and k is a positive number of from 4.5 to 6.5;

a non-magnetic color toner-developing means comprising a second developer disposed thereon for developing an electrostatic latent image having a non-magnetic color toner to form a non-magnetic color toner image on the electrostatic image-bearing member, wherein the non-magnetic color toner has a volume-average particle size of 4 to 15 microns;

a transfer means for transferring the toner image formed on the electrostatic image-bearing member to a transfer-receiving material; and a cleaning means for blade-cleaning the surface of the electrostatic image-bearing member after the transfer.

2. An image forming apparatus according to claim 1, wherein the non-magnetic color toner has a volume-average particle size of 5-15 microns which is larger than that of the magnetic toner by 1 micron or more than 1 micron.

3. An image forming apparatus according to claim 2, wherein the non-magnetic color toner has a volume-average particle size which is larger than that of the magnetic toner by 1-8 microns.

4. An image forming apparatus according to claim 1, wherein the magnetic toner contains 25-50% by number of magnetic toner particles having a particle size of 5 microns or smaller.

5. An image forming apparatus according to claim 1, wherein the magnetic toner contains 30-50% by number of magnetic toner particles having a particle size of 5 microns or smaller.

6. An image forming apparatus according to claim 1, wherein the magnetic toner satisfies the formula wherein k is 4.5 to 6.0.

7. An image forming apparatus according to claim 1, wherein the magnetic toner satisfies the formula wherein k is 4.5 to 5.5.

8. An image forming apparatus according to claim 1, wherein the magnetic toner contains 1.0% by volume or less of magnetic toner particles having a size of 16 microns or larger.

9. An image forming apparatus according to claim 1, wherein the magnetic toner contains 0.5% by volume or less of magnetic toner particles having a size of 16 microns or larger.

10. An image forming apparatus according to claim 1, wherein the magnetic toner has a volume-average particle size of 4-8 microns.

11. An image forming apparatus according to claim 1, wherein the magnetic toner has a degree of aggregation of 50-90%.

12. An image forming apparatus according to claim 1, wherein the magnetic toner has a degree of aggregation of 50-80%.

13. An image forming apparatus according to claim 1, wherein the magnetic toner has a true density of 1.45-1.70 g/cm$^3$.

14. An image forming apparatus according to claim 1, wherein the magnetic toner has a true density of 1.50-1.65 g/cm$^3$.

15. An image forming apparatus according to claim 1, wherein the magnetic toner has a remanence $\sigma_r$ of 1-5 emu/g, a saturation magnetization $\sigma_s$ of 20-40 emu/g and a coercive force $H_c$ of 400-100 Oersted.

16. An image forming apparatus according to claim 1, wherein the cleaning means comprises a cleaning blade and a cleaning roller.

17. An image forming apparatus according to claim 16, wherein the cleaning roller comprises a surface layer of an elastic material.

18. An image forming apparatus according to claim 17, wherein the cleaning roller comprises an elastic surface layer of urethane rubber or silicone rubber.

19. An image forming apparatus according to claim 16, wherein the cleaning roller comprises a magnetic roller carrying a magnetic toner on the surface thereof.

20. An image forming apparatus according to claim 1, wherein the cleaning means comprises a cleaning blade of an elastic material.

21. An image forming apparatus according to claim 20, wherein the cleaning blade is formed from urethane rubber or silicone rubber.

22. An image forming apparatus according to claim 20, wherein the cleaning blade has a thickness of 0.5-4 mm and a rubber hardness (JIS-A) of 50 degrees-90 degrees, and the cleaning blade is pushed against the surface of the electrostatic image-bearing member at a pressure of 5-40 g/cm.

23. An image forming apparatus according to claim 17, wherein the cleaning roller comprises a surface layer of urethane rubber of silicone rubber having a rubber hardness (JIS-A) of 50 degrees-90 degrees and is pressed against the surface of the electrostatic image-bearing member so as to cause a depression of 0.5-2 mm.

24. An image forming apparatus according to claim 1, wherein the non-magnetic color toner developing means comprises a non-magnetic color toner and a magnetic carrier.

25. An image forming apparatus according to claim 1, wherein the non-magnetic color toner and the magnetic toner comprise a binder resin, and the binder resin comprises a material selected from the group consisting of a vinyl polymer and a polyester resin.

26. An image forming apparatus according to claim 25, wherein the binder resin comprises a styrene copolymer.

27. An image forming apparatus according to claim 26, wherein the binder resin is a styrene-acrylic acid ester copolymer, a styrene-methacrylic acid ester copolymer or mixture thereof.

28. An image forming apparatus according to claim 1, wherein the non-magnetic color toner and the magnetic toner comprise a binder resin, a charge controller and a waxy substance.

29. An image forming apparatus according to claim 28, wherein the non-magnetic toner and the magnetic toner contains a nigrosine compound or an organic quaternary ammonium salt and has a positive triboelectric chargeability.

30. An image forming apparatus according to claim 29, wherein the non-magnetic toner and the magnetic toner are respectively mixed with silica fine powder externally added.

31. An image forming apparatus according to claim 28, wherein the non-magnetic toner and the magnetic toner contains an organic metal complex and has a negative triboelectric chargeability.

32. An image forming apparatus according to claim 1, wherein the non-magnetic color toner developing means and the magnetic toner developing respectively comprise an alternating electric field application means for causing the toner to jump.

33. An image forming apparatus according to claim 1, wherein the electrostatic image-bearing member comprises an organic photo-conductive layer.

34. An image forming method, comprising:

developing an electrostatic latent image on an electrostatic image-bearing member with a developer comprising a non-magnetic color tonerr having a volume-average particle size of 4 to 15 microns to form a non-magnetic color toner image;

transferring the non-magnetic color toner image on the electrostatic image-bearing member to a transfer-receiving material;

cleaning the electrostatic image-bearing member after the transfer with a cleaning blade;

forming an electrostatic image on the electrostatic image-bearing member after the cleaning;

developing the electrostatic latent image on the electrostatic image-bearing member with a developer comprising a magnetic toner to form a magnetic toner image, wherein the magnetic toner contains 17 to 60% by number of magnetic toner particles having a particle size of 5 microns or smaller, 1-23% by number of magnetic toner particles having a particle size of 8.0-12.7 microns and 2.0% by volume or less of magnetic toner particles having a size of 16 microns or larger, wherein the magnetic toner has a volume-average particle size of 4-9 microns and a degree of aggregation of 50-95%; and wherein the magnetic toner has a particle size distribution satisfying the following formula:

$$N/V = -0.04N + k,$$

where N denotes the value of % by number of magnetic particles having a size of 5 microns or smaller, namely a positive number of 17 to 60, V denotes the value of % by volume of magnetic particles having a size of 5 microns or smaller, and k is a positive number of from 4.5 to 6.5;

transferring the magnetic toner image on the electrostatic image-bearing member to the transfer-receiving material; and cleaning the electrostatic image-bearing member after the transfer with a cleaning blade.

35. An image forming method according to claim 34, wherein the non-magnetic color toner has a volume-average particle size of 5-15 microns which is larger than that of the magnetic toner by 1 micron or more than 1 micron.

36. An image forming method according to claim 35, wherein the non-magnetic color toner has a volume-average particle size which is larger than that of the magnetic toner by 1-8 microns.

37. An image forming method according to claim 34, wherein the magnetic toner contains 25-50% by number of magnetic toner particles having a particle size of 5 microns or smaller.

38. An image forming method according to claim 34, wherein the magnetic toner contains 30-50% by number of magnetic toner particles having a particle size of 5 microns or smaller.

39. An image forming method according to claim 34, wherein the magnetic toner satisfies the formula wherein k is 4.5 to 6.0.

40. An image forming method according to claim 34, wherein the magnetic toner satisfies the formula wherein k is 4.5 to 5.5.

41. An image forming method according to claim 34, wherein the magnetic toner contains 1.0% by volume or less of magnetic toner particles having a size of 16 microns or larger.

42. An image forming method according to claim 34, wherein the magnetic toner contains 0.5% by volume or less of magnetic toner particles having a size of 16 microns or larger.

43. An image forming method according to claim 34, wherein the magnetic toner has a volume-average particle size of 4-8 microns.

44. An image forming method according to claim 34, wherein the magnetic toner has a degree of aggregation of 50-90%.

45. An image forming method according to claim 34, wherein the magnetic toner has a degree of aggregation of 50-80%.

46. An image forming method according to claim 34, wherein the magnetic toner has a true density of 1.45-1.70 g/cm$^3$.

47. An image forming method according to claim 34, wherein the magnetic toner has a true density of 1.50-1.65 g/cm$^3$.

48. An image forming method according to claim 34, wherein the magnetic toner has a remanence $\sigma_r$ of 1-5 emu/g, a saturation magnetization $\sigma_s$ of 20-40 emu/g and a coercive force $H_c$ of 400-100 Oersted.

49. An image forming method according to claim 34, wherein the electrostatic image-bearing member is cleaned by cleaning blade and a cleaning roller.

50. An image forming method according to claim 49, wherein the cleaning roller comprises a surface layer of an elastic material.

51. An image forming method according to claim 50, wherein the cleaning roller comprises an elastic surface layer of urethane rubber or silicone rubber.

52. An image forming method according to claim 49, wherein the cleaning roller comprises a magnetic roller carrying a magnetic toner on the surface thereof.

53. An image forming method according to claim 34, wherein the electrostatic image-bearing member is cleaned by a cleaning bladed of an elastic material.

54. An image forming method according to claim 53, wherein the cleaning blade is formed from urethane rubber or silicone rubber.

55. An image forming method according to claim 53, wherein the cleaning blade has a thickness of 0.5-4 mm and a rubber hardness (JIS-A) of 50 degrees-90 degrees, and the cleaning blade is pushed against the surface of the electrostatic image-bearing member at a pressure of 5-40 g/cm.

56. An image forming method according to claim 49, wherein the cleaning roller comprises a surface layer of urethane rubber of silicone rubber having a rubber hardness (JIS-A) of 50 degrees-90 degrees and is pressed against the surface of the electrostatic image-bearing member so as to cause a depression of 0.5-2 mm.

57. An image forming method according to claim 34, wherein the non-magnetic color toner developing means comprises a non-magnetic color toner and a magnetic carrier.

58. An image forming method according to claim 34, wherein the non-magnetic color toner and the magnetic toner comprise a binder resin, and the binder resin comprises a material selected from the group consisting of a vinyl polymer and a polyester resin.

59. An image forming method according to claim 58, wherein the binder resin comprises a styrene copolymer.

60. An image forming method according to claim 59, wherein the binder resin is a styrene-acrylic acid ester copolymer, a styrene-methacrylic acid ester copolymer or a mixture thereof.

61. An image forming method according to claim 34, wherein the non-magnetic color toner and the magnetic toner comprise a binder resin, a charge controller and a waxy substance.

62. An image forming method according to claim 61, wherein the non-magnetic toner and the magnetic toner contains a nigrosine compound or an organic quaternary ammonium salt and has a positive triboelectric chargeability.

63. An image forming method according to claim 62, wherein the non-magnetic toner and the magnetic toner are respectively mixed with silica fine powder externally added.

64. An image forming method according to claim 61, wherein the non-magnetic toner and the magnetic toner contains an organic metal complex and has a negative triboelectric chargeability.

65. An image forming method according to claim 34, wherein the non-magnetic color toner developing means and the magnetic toner developing respectively comprise an alternating electric field application means for causing the toner to jump.

66. An image forming method according to claim 34, wherein the electrostatic image-bearing member comprises an organic photo-conductive layer.

67. An image forming method, comprising:

developing an electrostatic latent image on an electrostatic image-bearing member with a developer comprising a magnetic tonerr to form a magnetic toner image, wherein the magnetic toner contains 17 to 60% by number of magnetic toner particles having a particle size of 5 microns or smaller, 1-23% by number of magnetic toner particles having a particle size of 8.0-12.7 microns and 2.0% by volume or less of magnetic toner particles having a size of 16 microns or larger, wherein the magnetic toner has a volume-average particle size of 4-9 microns and a degree of aggregation of 50-95%, and wherein the magnetic toner has a particle size distribution satisfying the following formula:

$$N/V = -0.04N + k$$

where N denotes the value of % by number of magnetic particles having a size of 5 microns or smaller, namely a positive number of 17 to 60, V denotes the value of % by volume of magnetic particles having a size of 5 microns or smaller, and k is a positive number of from 4.5 to 6.5;

transferring the magnetic toner image on the electrostatic image-bearing member to the transfer-receiving material;

cleaning the electrostatic image-bearing member after the transfer with a cleaning blade;

forming an electrostatic image on the electrostatic image-bearing member after the cleaning;

developing the electrostatic latent image on the electrostatic image-bearing member with a developer comprising a non-magnetic color toner having a volume-average particle size of 4 to 15 microns to form a non-magnetic color toner image;

transferring the non-magnetic color toner image on the electrostatic image-bearing member to the transfer-receiving material; and cleaning the electrostatic image-bearing member after the transfer with a cleaning blade.

68. An image forming method according to claim 67, wherein the non-magnetic color toner has a volume-average particle size of 5-15 microns which is larger than that of the magnetic toner by 1 micron or more than 1 microns.

69. An image forming method according to claim 68, wherein the non-magnetic color toner has a volume-average particle size which is larger than that of the magnetic toner by 1-8 microns.

70. An image forming method according to claim 67, wherein the magnetic toner contains 25-50% by number of magnetic toner particles having a particle size of 5 microns or smaller.

71. An image forming method according to claim 67, wherein the magnetic toner contains 30-50% by number of magnetic toner particles having a particle size of 5 microns or smaller.

72. An image forming method according to claim 67, wherein the magnetic toner satisfies the formula wherein k is 4.5 to 6.0.

73. An image forming method according to claim 67, wherein the magnetic toner satisfies the formula wherein k is 4.5 to 5.5.

74. An image forming method according to claim 67, wherein the magnetic toner contains 1.0% by volume or less of magnetic toner particles having a size of 16 microns or larger.

75. An image forming method according to claim 67, wherein the magnetic toner contains 0.5% by volume or less of magnetic toner particles having a size of 16 microns or larger.

76. An image forming method according to claim 67, wherein the magnetic toner has a volume-average particle size of 4-8 microns.

77. An image forming method according to claim 67, wherein the magnetic toner has a degree of aggregation of 50-90%.

78. An image forming method according to claim 67, wherein the magnetic toner has a degree of aggregation of 50-80%.

79. An image forming method according to claim 1, wherein the magnetic toner has a true density of 1.45-1.70 g/cm$^3$.

80. An image forming method according to claim 67, wherein the magnetic toner has a true density of 1.50-1.65 g/cm$^3$.

81. An image forming method according to claim 67, wherein the magnetic toner has a remanence $\sigma_r$ of 1-5 emu/g, a saturation magnetization $\sigma_s$ of 20-40 emu/g and a coercive force $H_c$ of 400-100 Oersted.

82. An image forming method according to claim 67, wherein the electrostatic image-bearing member is cleaned by a cleaning blade and a cleaning roller.

83. An image forming method according to claim 82, wherein the cleaning roller comprises a surface layer of an elastic material.

84. An image forming method according to claim 83, wherein the cleaning roller comprises an elastic surface layer of urethane rubber or silicone rubber.

85. An image forming method according to claim 82, wherein the cleaning roller comprises a magnetic roller carrying a magnetic toner on the surface thereof.

86. An image forming method according to claim 67, wherein the electrostatic image-bearing member is cleaned by a cleaning bladed of an elastic material.

87. An image forming method according to claim 86, wherein the cleaning blade is formed from urethane rubber or silicone rubber.

88. An image forming method according to claim 86, wherein the cleaning blade has a thickness of 0.5–4 mm and a rubber hardness (JIS-A) of 50 degrees–90 degrees, and the cleaning blade is pushed against the surface of the electrostatic image-bearing member at a pressure of 5–40 g/cm.

89. An image forming method according to claim 82, wherein the cleaning roller comprises a surface layer of urethane rubber of silicone rubber having a rubber hardness (JIS-A) of 50 degrees–90 degrees and is pressed against the surface of the electrostatic image-bearing member so as to cause a depression of 0.5–2 mm.

90. An image forming method according to claim 67, wherein the non-magnetic color toner developing means comprises a non-magnetic color toner and a magnetic carrier.

91. An image forming method according to claim 67, wherein the non-magnetic color toner and the magnetic toner comprise a binder resin, and the binder resin comprises a material selected from the group consisting of a vinyl polymer and a polyester resin.

92. An image forming method according to claim 91, wherein the binder resin comprises a styrene copolymer.

93. An image forming method according to claim 92, wherein the binder resin is a styrene-acrylic acid ester copolymer, a styrene-methacrylic acid ester copolymer or a mixture thereof.

94. An image forming method according to claim 67, wherein the non-magnetic color toner and the magnetic toner comprise a binder resin, a charge controller and a waxy substance.

95. An image forming method according to claim 94, wherein the non-magnetic toner and the magnetic toner contains a nigrosine compound or an organic quaternary ammonium salt and has a positive triboelectric chargeability.

96. An image forming method according to claim 95, wherein the non-magnetic toner and the magnetic toner are respectively mixed with silica fine powder externally added.

97. An image forming method according to claim 94, wherein the non-magnetic toner and the magnetic toner contains an organic metal complex and has a negative triboelectric chargeability.

98. An image forming method according to claim 67, wherein the non-magnetic color toner developing means and the magnetic toner developing respectively comprise an alternating electric field application means for causing the toner to jump.

99. An image forming method according to claim 67, wherein the electrostatic image-bearing member comprises an organic photo-conductive layer.

* * * * *

UNITED STATES PATENT AND TRADEMARK OFFICE

CERTIFICATE OF CORRECTION

PATENT NO. : 5,009,973

DATED : April 23, 1991

INVENTOR(S) : SATOSHI YOSHIDA, ET AL.

It is certified that error appears in the above-identified patent and that said Letters Patent is hereby corrected as shown below:

Title page:

IN [56] REFERENCES CITED

Column 2, "Primary Examiner—7" should read --Primary Examiner—Roland Martin--.

Column 2, "Assistant Examiner—Roland Martin" should be deleted.

IN [57] ABSTRACT

Line 18, "micron" should read --microns--.

COLUMN 1

Line 5, "RELATED" should read --RELATED ART--.
Line 32, "dots" (first occurrence) should be deleted.

COLUMN 2

Line 15, "2054/1979" should read --72054/1979--.
Line 19, "has" should read --have--.
Line 20, "a" should be deleted.
Line 23, "29437/1983" should read --129437/1983--.
Line 24, "114310)" should read --2114310)--.

COLUMN 8

Line 16, "years" should read --ears--.

COLUMN 10

Line 28, "is" should read --are--.
Line 56, "micron" should read --microns--.

UNITED STATES PATENT AND TRADEMARK OFFICE

CERTIFICATE OF CORRECTION

PATENT NO. : 5,009,973

DATED : April 23, 1991

INVENTOR(S) : SATOSHI YOSHIDA, ET AL.

It is certified that error appears in the above-identified patent and that said Letters Patent is hereby corrected as shown below:

COLUMN 11

Line 43, "microns" should read --microns, there--.

COLUMN 12

Line 10, "Form" should read --From--.

COLUMN 13

Line 30, "vibration. The" should read --vibration, the--.
Line 43, "fog," should read --fog--.
Line 46, "hand," should read --hand, if--.

COLUMN 15

Line 24, "these" should read --These--.
Line 68, "represents" should read --represented--.

COLUMN 16

Line 8, "represent" should read --$R_3$ each represent--.

COLUMN 19

Line 51, "dipropylaminopropyltrtimethoxysilane" should read --dipropylaminopropyltrimethoxysilane--.

COLUMN 20

Line 12, "a" should read --or--.
Line 26, "benzyldimethylcholrosilane" should read --benzyldimethylchlorosilane--.

UNITED STATES PATENT AND TRADEMARK OFFICE

CERTIFICATE OF CORRECTION

PATENT NO. : 5,009,973

DATED : April 23, 1991

INVENTOR(S) : SATOSHI YOSHIDA, ET AL.

It is certified that error appears in the above-identified patent and that said Letters Patent is hereby corrected as shown below:

COLUMN 21

Line 4, "preferable" should read --preferably--.
Line 6, "microns" should read --micron--.
Line 13, "on" should read --or--.
Line 51, "applied" should read --is applied--.
Line 57, "formed" should read --forms--.

COLUMN 22

Line 49, "member, and a" should read --member. A--.
Line 66, "surface" should read --surfaces--.

COLUMN 23

Line 50, "shrinked" should read --that shrinks--.

COLUMN 28

Line 23, "black" should read --block--.
Line 43, "are" should read --is--.

COLUMN 29

Line 59, "classifier" should read --classifiers--.

COLUMN 31

Line 62, "formed" should read --is formed--.
Line 64, "sleeve 733" should read --sleeve 707--.
Line 68, "drum 707" should read --drum 701--.

UNITED STATES PATENT AND TRADEMARK OFFICE

CERTIFICATE OF CORRECTION

PATENT NO. : 5,009,973

DATED : April 23, 1991

INVENTOR(S) : SATOSHI YOSHIDA, ET AL.

It is certified that error appears in the above-identified patent and that said Letters Patent is hereby corrected as shown below:

COLUMN 32

Line 46, "a" should read --¶ a--.
Line 50, "tonerr" should read --toner--.

COLUMN 34

Line 26, "17," should read --16,--.
Line 68, "developing" should read --developing means--.

COLUMN 35

Line 9, "tonerr" should read --toner--.

COLUMN 36

Line 33, "by" should read --by a--.
Line 45, "bladed" should read --blade--.
Line 57, "of" should read --or--.

COLUMN 37

Line 29, "developing" should read --developing means--.
Line 38, "tonerr" should read --toner--.

COLUMN 39

Line 6, "bladed" should read --blade--.
Line 19, "of" should read --or--.

UNITED STATES PATENT AND TRADEMARK OFFICE

CERTIFICATE OF CORRECTION

PATENT NO. : 5,009,973

DATED : April 23, 1991

INVENTOR(S) : SATOSHI YOSHIDA, ET AL.

It is certified that error appears in the above-identified patent and that said Letters Patent is hereby corrected as shown below:

COLUMN 40

Line 27, "developing" should read --developing means--.

Signed and Sealed this

Fifteenth Day of June, 1993

Attest:

Michael K. Kirk

MICHAEL K. KIRK

Attesting Officer

Acting Commissioner of Patents and Trademarks